US010222150B2

(12) United States Patent
Reynolds

(10) Patent No.: US 10,222,150 B2
(45) Date of Patent: Mar. 5, 2019

(54) LATCHED CHARGING HANDLE WITH MECHANICAL ADVANTAGE SEPARATOR

(71) Applicant: Springfield, Inc., Geneseo, IL (US)

(72) Inventor: S. Paul Reynolds, Galesburg, IL (US)

(73) Assignee: Springfield, Inc., Geneseo, IL (US)

( * ) Notice: Subject to any disclaimer, the term of this patent is extended or adjusted under 35 U.S.C. 154(b) by 0 days.

(21) Appl. No.: 15/913,378

(22) Filed: Mar. 6, 2018

(65) Prior Publication Data

US 2018/0266779 A1 Sep. 20, 2018

Related U.S. Application Data

(60) Provisional application No. 62/467,553, filed on Mar. 6, 2017.

(51) Int. Cl.
*F41A 3/72* (2006.01)

(52) U.S. Cl.
CPC ..... *F41A 3/72* (2013.01)

(58) Field of Classification Search
CPC ..... F41A 3/72; F41A 7/02
USPC ..... 89/1.4
See application file for complete search history.

(56) References Cited

U.S. PATENT DOCUMENTS 2,332,631 A 10/1943 Gasser
2,845,001 A 7/1958 Hillberg
3,225,653 A 12/1965 Packard
7,240,600 B1 7/2007 Bordson
7,827,896 B2 11/2010 Hektoen et al.
7,832,322 B1 * 11/2010 Hoel ..... F41A 35/06 42/16
7,900,546 B2 3/2011 Bordson
8,104,393 B2 * 1/2012 Kincel ..... F41A 3/72 42/16
8,261,649 B2 * 9/2012 Fitzpatrick ..... F41A 19/47 89/1.4
8,336,436 B2 * 12/2012 Kincel ..... F41A 35/06 42/16
8,356,537 B2 1/2013 Kincel
8,820,210 B2 9/2014 Melville
9,366,489 B1 * 6/2016 Strom ..... F41A 35/06
9,506,703 B1 11/2016 Strom
9,587,896 B1 * 3/2017 Huang ..... F41A 35/06
9,683,795 B1 * 6/2017 Novak ..... F41A 35/06
9,846,003 B2 * 12/2017 Hwang ..... F41A 35/06
9,964,371 B1 * 5/2018 Huang ..... F41A 35/06
(Continued)

OTHER PUBLICATIONS

AR15 Ejection Port https://outdoorsportsusa.com/index.php?route=product/product&product_id=968.
(Continued)

*Primary Examiner* — Joshua E Freeman
(74) *Attorney, Agent, or Firm* — Woodard, Emhardt, Henry, Reeves & Wagner, LLP

(57) ABSTRACT

Charging handles having a mechanical advantage separator for separating an end of the charging handle from a portion of a firearm are disclosed. Specifically, charging handles having a simple machine, such as a lever, are disclosed. Advantageously, the simple machine can multiply the force applied by a user on the charging handle. Additionally, in at least some instances, the simple machine will actuate a charging handle latch so as to disengage the charging handle latch from a receiver of the firearm.

20 Claims, 33 Drawing Sheets

(56) References Cited

U.S. PATENT DOCUMENTS

2011/0005372 A1* 1/2011 Kincel ..... F41A 3/72 89/1.4
2011/0174139 A1* 7/2011 Olsen ..... F41A 3/72 89/1.4
2011/0214558 A1* 9/2011 Kincel ..... F41A 9/00 89/1.4
2011/0226120 A1* 9/2011 Fitzpatrick ..... F41A 19/47 89/1.4
2011/0265636 A1* 11/2011 Overstreet ..... F41A 3/72 89/1.4
2012/0291612 A1* 11/2012 Kincel ..... F41A 3/72 89/1.4
2013/0192113 A1* 8/2013 Melville ..... F41A 3/72 89/1.4
2014/0060293 A1* 3/2014 Gomez ..... F41A 3/72 89/1.4
2014/0345444 A1* 11/2014 Hillman ..... G01N 15/06 89/1.4
2015/0053072 A1 2/2015 Bunker
2015/0233657 A1* 8/2015 Barker ..... F41A 3/72 89/1.4
2015/0233663 A1 8/2015 Kiehn
2015/0253105 A1* 9/2015 Brubaker ..... F41A 3/72 42/90
2015/0308762 A1* 10/2015 McGinty ..... F41A 35/06 89/1.4
2016/0061542 A1* 3/2016 Daley, Jr. ..... F41A 3/72 89/1.4
2016/0109199 A1 4/2016 Davison et al.
2016/0178298 A1* 6/2016 Daniel ..... F41A 3/72 89/1.4
2016/0298917 A1* 10/2016 Hwang ..... F41A 35/06
2016/0320151 A1* 11/2016 Kincel ..... F41A 3/72
2016/0356564 A1* 12/2016 Curry ..... F41A 3/72
2018/0149438 A1* 5/2018 Headrick ..... F41A 9/59

OTHER PUBLICATIONS

AR15_Charging_Handle https://outdoorsportsusa.com/AR-15-Tactical-Rifle-Charging-Handle-Assembly-W-Extended-Ambidextrou.
Atch Charging Handle https://www.ar15goa.com/product/ar15goa-5-56mm-atch-charging-handle/.
Tactical Charging Handle for AR15.

* cited by examiner

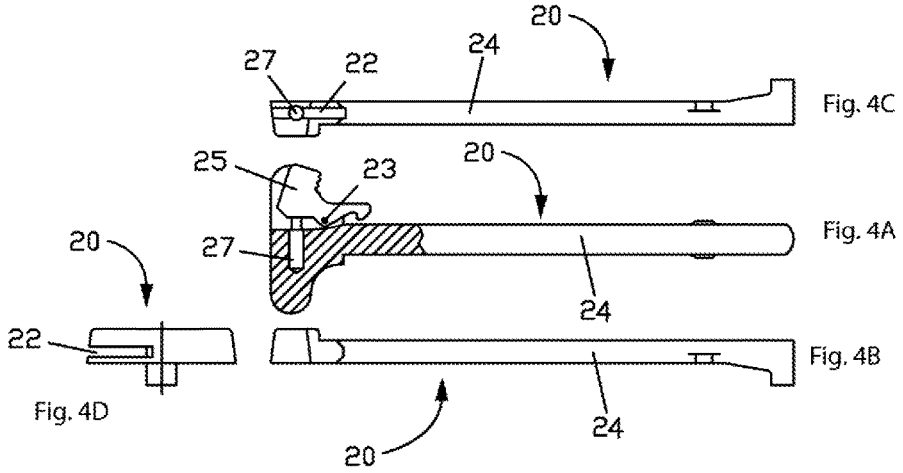
20
27
22
24
Fig. 4C
25
23
20
20
27
Fig. 4A
24
22
Fig. 4B
Fig. 4D
24
20
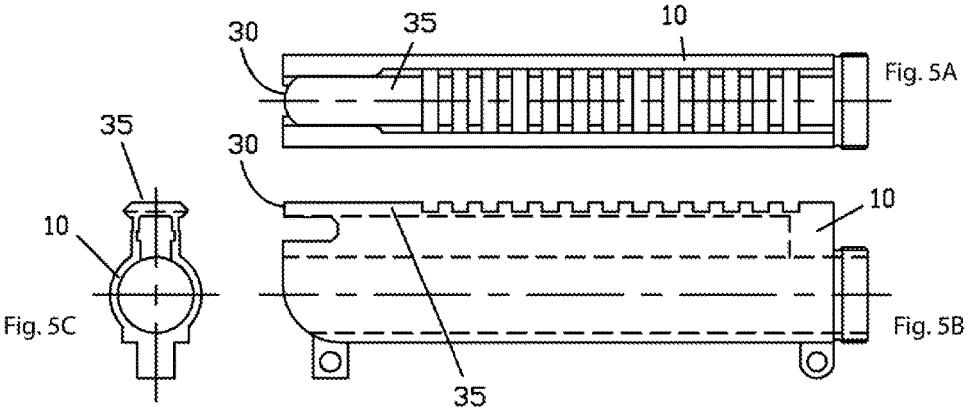
30
35
10
Fig. 5A
35
30
10
10
Fig. 5C
Fig. 5B
35
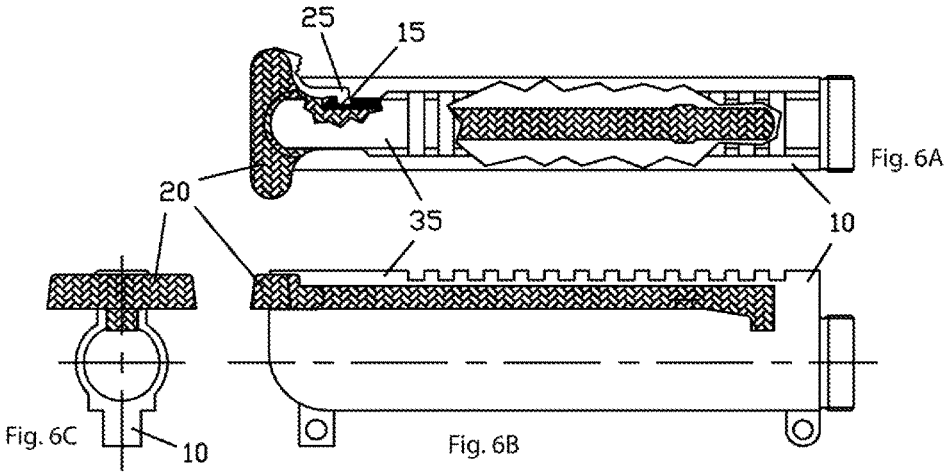
25
15
Fig. 6A
20
35
10
Fig. 6C
10
Fig. 6B Fig. 8
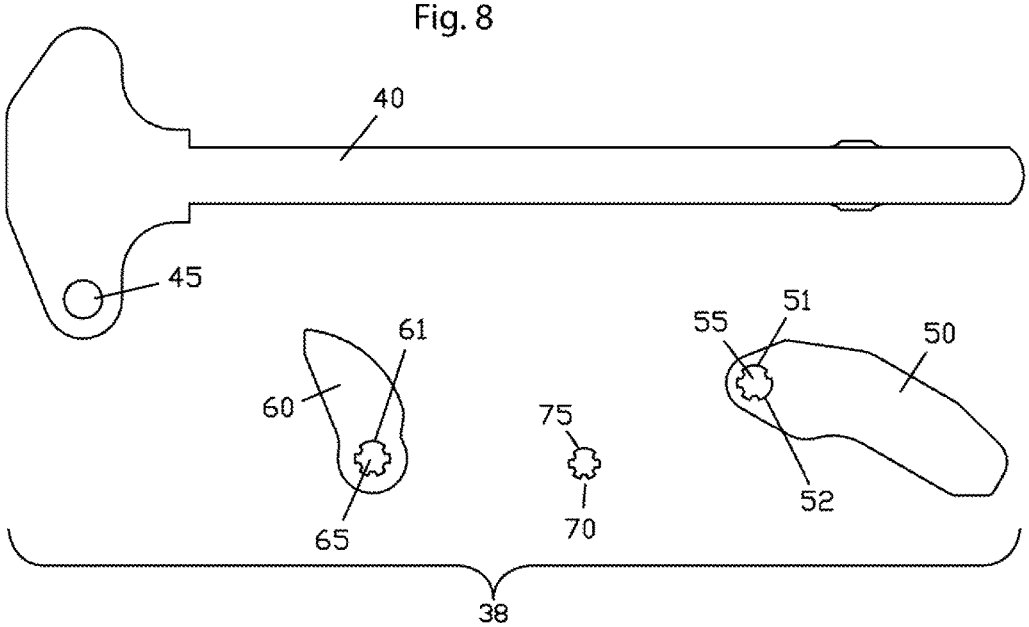
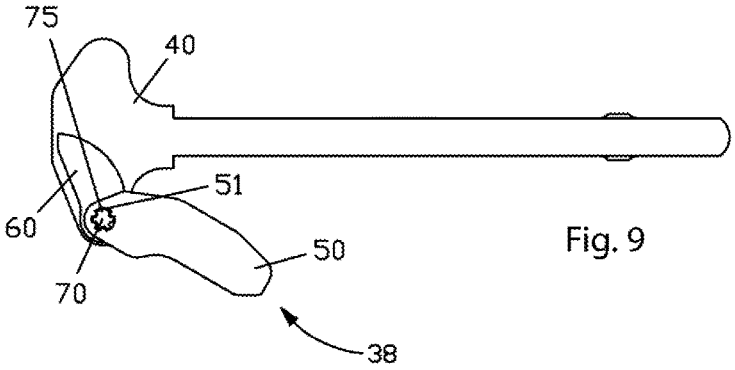
Fig. 9
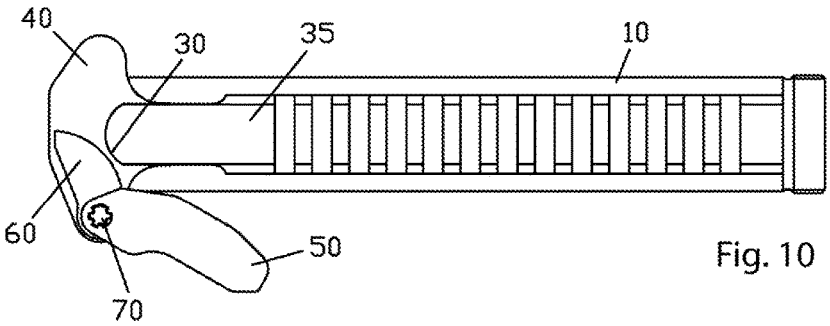
Fig. 10

Fig. 33A
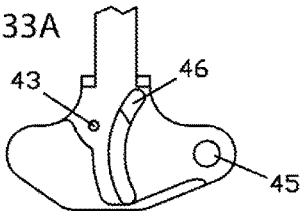
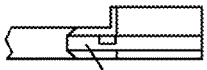
Fig. 33B
Fig. 33C
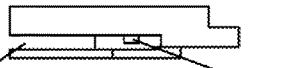
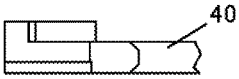
Fig. 33D
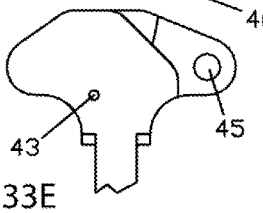
Fig. 33E
Fig. 34A
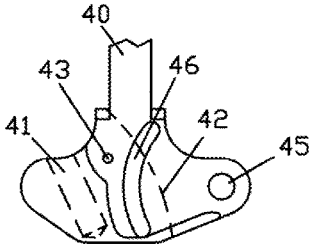
Fig. 34C
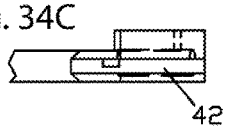
Fig. 34B
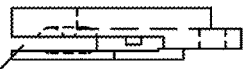
Fig. 34D
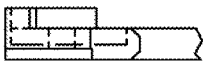
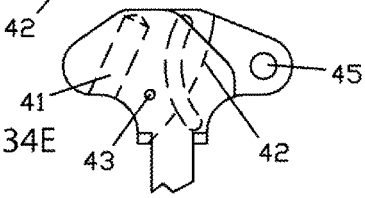
Fig. 34E
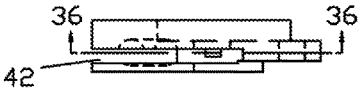
Fig. 35
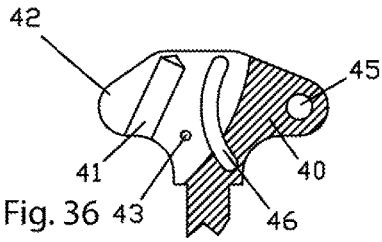
Fig. 36

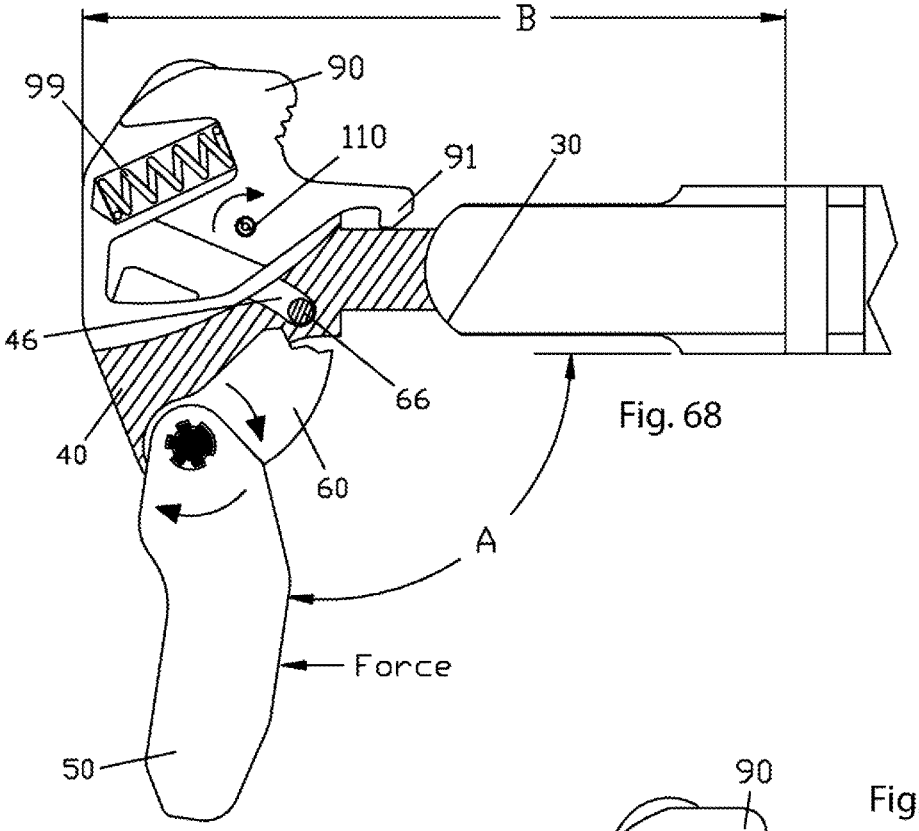
Fig. 68
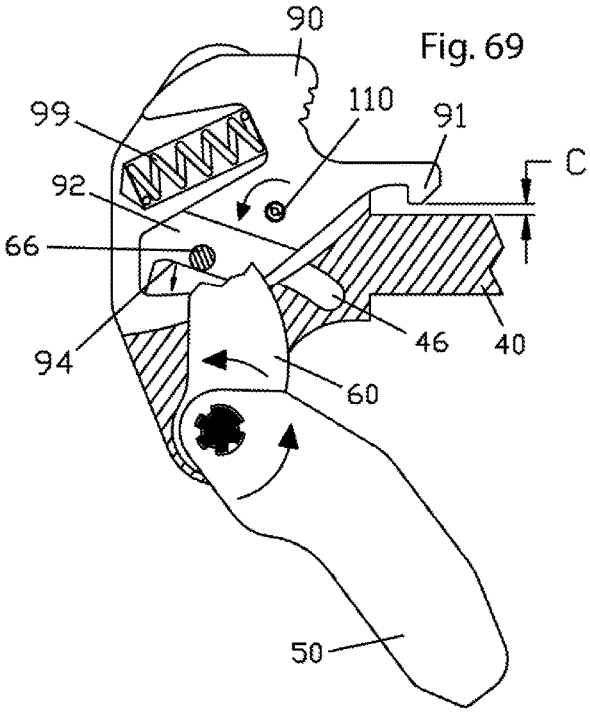
Fig. 69
Fig. 70
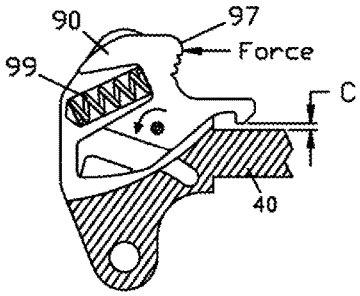

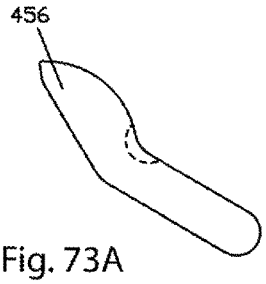
Fig. 73A
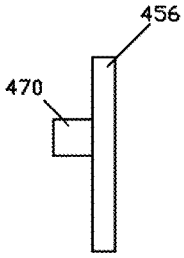
Fig. 73B
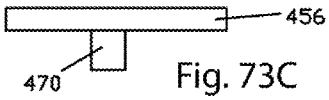
Fig. 73C
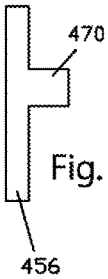
Fig. 73D
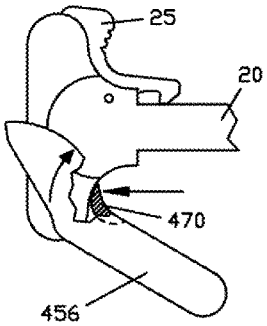
Fig. 74A
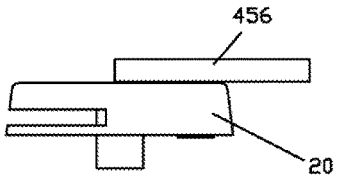
Fig. 74B
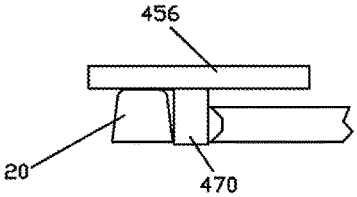
Fig. 74C
Fig. 75
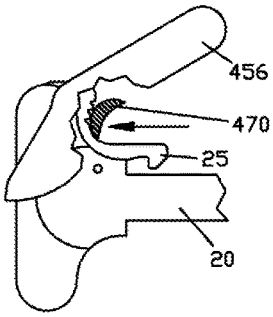

LATCHED CHARGING HANDLE WITH MECHANICAL ADVANTAGE SEPARATOR

BACKGROUND

The present disclosure pertains generally to firearms. In particular, the present disclosure pertains to charging handles for firearms.

Firearms occasionally experience malfunctions. There are numerous types and causes of malfunctions. One particular type of malfunction is a stuck case malfunction. In a stuck case malfunction, the firearm fails to extract a cartridge-case that has become lodged in the chamber. The cartridge-case can become lodged due to a number of reasons. For example, the cartridge case may be lodged due to over-expansion of the cartridge-case upon firing of the firearm.

As a stuck case malfunction prevents further loading of cartridges into the chamber, the firearm cannot be fired until the stuck case is extracted. The consequences for failing to successfully extract a stuck case can range from the inconvenient, to the catastrophic. In a combat situation, failing to clear a stuck case malfunction can be life threatening. Accordingly, there is a desire to be able to clear such malfunctions quickly and easily when they occur.

When a stuck case malfunction is encountered in an AR style firearm (e.g., AR-15 or M-16), a common method currently employed to clear it is to force the charging handle rearward while simultaneously slamming the butt of the rifle on the ground. In some instances, an operator may need to perform this maneuver repeatedly before the bolt successfully opens and/or extracts the cartridge-case from the chamber of the firearm. Unfortunately, this method of clearing a stuck case malfunction can be dangerous and potentially damaging to the rifle. Additionally, in some instances, this method is unsuccessful in clearing a stuck case malfunction. Accordingly, there is a desire for new devices and methods for clearing such a malfunction.

SUMMARY OF THE PRESENT INVENTION

The present disclosure pertains generally to firearms. In particular, the present disclosure pertains to charging handles for firearms. More specifically, the present disclosure provides charging handles having structure, such as a simple machine, for providing a mechanical advantage when opening a bolt of a firearm, especially firearms experiencing a stuck case malfunction.

For simplicity, the present disclosure has been described with reference to clearing a stuck case malfunction in a firearm. However, the present disclosure should not be limited as such. The present disclosure is envisioned as being useful for clearing other malfunctions as well.

Additionally while not limited to such, the present invention is particularly advantageous for AR style firearms (e.g., AR-15 and M-16 rifles). Unfortunately, the location of the charging handle of the AR family of rifles is poorly suited for allowing an operator to apply a large amount of rearward force to the charging handle. Unlike charging handles which protrude from the sides of the rifles, the charging handle on AR style firearms is relatively small and centered above and in close proximity to the buttstock. Side-projecting charging handles can, in many instances, allow the operator to, in an emergency, stomp on them with their foot. However, due to the location of the charging handle, operators of AR style firearms, in many instances, are limited to using their fingers to grip the charging handle. Accordingly, the operator's finger strength is a limiting factor in the amount of force they can apply to move the charging handle of an AR style firearm rearward.

Clearing a stuck cartridge-case malfunction can require significant force. Accordingly, firearms with small, low-profile, or otherwise difficult to reach/grasp charging handles can be very difficult, or even impossible, to clear because the operator is unable to apply the needed force. Notably, AR style firearms are not equipped with opening-cams, unlike bolt action rifles or bolt lugs of semi/full-auto rifles that cam directly against the receiver or barrel extension.

The charging handles disclosed here provide a force-multiplying structure wherein even very tightly stuck cartridge cases can be cleared from firearms. The charging handles disclosed herein include a simple machine (e.g., a lever, a pulley, a wedge, and/or a screw) to provide a mechanical advantage (e.g., leverage) to force the charging handle rearward and open the bolt. For example, the charging handle can use a lever to multiply the force applied by an operator to facilitate the extraction of jammed cartridges. As used in this disclosure, the term "mechanical advantage" includes mechanisms that achieve greater force for retracting the charging handle than is manually applied to the device.

Advantageously, in embodiments having a lever, the lever can provide a greater surface area for an operator to contact than a traditional M-16 charging handle.

Additionally, charging handle designs disclosed herein can be operated ambidextrously while still disengaging a charging handle latch of the charging handle from the firearm. For example, a charging handle removal lever can be positioned on an opposing side of a charging handle base than the charging handle latch and be arranged to actuate the charging handle latch to disengage the charging handle latch from the firearm. In this way, the charging handle can be unlatched from either side of the firearm.

Briefly stated immediately below, and then elaborated upon further below, advantages of the present disclosure can include:

- Simplicity/ease of use
- Compact/light weight
- Configurable into/from a stowable configuration
- Drop-in compatible with existing rifles
- Does not interfere with normal operation of the rifle
- Provides ambidextrous operation of the charging handle
- Provides mechanical advantage for extracting a stuck cartridge-case The charging handles disclosed here can be simple, and in many instances include only a few parts. In fact, in its simplest form, the charging handle may consist of two pieces.

The charging handle is compact and light weight. The charging handle may only add about one ounce of weight. Advantageously, charging handles disclosed herein can be configured into a stowed configuration that reduces the overall size of the charging handle when not in use.

The charging handles disclosed herein are easy to use. Levers of charging handles disclosed herein can be easily deployed, and stowed. Further, operation of a mechanical advantage separator of the present disclosure may operate the charging handle latch so as to disengage the charging handle latch from a slot in a receiver of the firearm.

The charging handles disclosed herein are suitable as a drop-in system. The charging handle can be employed in existing rifle platforms without any other modification to the rifle.

The charging handles disclosed herein do not interfere with the normal operation of the rifle. When the lever is stowed, the charging handle base and the charging handle latch function in exactly the same way as a standard charging handle and charging handle latch. When deployed, the lever does not prevent the operator from using the charging handle in the usual manner. Nor do the charging handles disclosed herein interfere with the use of the forward-assist.

Where the terms "comprise", "comprises", "comprised" or "comprising" are used in this specification (including the claims) they are to be interpreted as specifying the presence of the stated features, integers, steps or components, but not precluding the presence of one or more other features, integers, steps or components, or group thereof.

The present disclosure provides a charging handle for a firearm comprising: a charging handle base having a first end and a second end; the first end arranged for positioning within a housing of the firearm; the second end having a charging handle latch pivotably attached thereto, the charging handle latch arranged to engage the firearm to retain the second end in fixed position relative to the housing; and a rearward-assist member arranged to provide a mechanical advantage upon application of a force to move the second end of the charging handle base away from the housing when the charging handle latch is disengaged from the firearm. The rearward-assist member can be a simple machine. The simple machine can be a lever.

The present disclosure provides a charging handle for a firearm comprising: a charging handle base having a first end and a second end; the first end arranged for positioning within the firearm; the second end having a charging handle latch pivotably attached thereto, the charging handle latch arranged to engage another part of the firearm to retain the second end in position; and a pivoting charging handle removal lever coupled to the charging handle base, the pivoting charging handle removal lever having three separate locations to achieve a mechanical advantage: (a) a first location which engages the charging handle base or the charging handle latch, (b) a second location which engages a different part of the firearm than the charging handle base or the charging handle latch, and (c) a third location exposed for application of manual force and positioned to achieve a mechanical advantage for releasing the charging handle when stuck in the firearm.

The first location can be positioned in an area between the second location and the third location. The second location can be positioned in an area between the first location and the third location.

The lever can disengage the charging handle latch from the firearm when actuated. For example, the lever can include a cam-lug that rotates the charging handle latch away from the charging handle base and/or the receiver during rotation of the pivoting charging handle removal lever.

The lever can include a handle portion extending from the first location to the third location and a load portion extending from the first location to the second location and the handle portion can be selectively pivotable relative to the load portion so as to configure the pivoting charging handle removal lever from stored configuration to a deployed configuration. For example, the handle portion can be coupled to the load portion (e.g., a cam) by a spline shaft having splines and the handle portion and load portion can each have spline openings having one or more teeth and gaps sized to engage the spline shaft. The spline shaft, the handle portion, and the load portion can be arranged such that the spline shaft rotationally couples the handle portion and the load portion in one or two or more configurations. The spline shaft can have a first circumferential portion that, when positioned within the spline opening of the handle portion, rotationally locks the spline shaft relative to the handle portion and the spline shaft can have a second circumferential portion that, when positioned within the spline opening of the handle portion, allows at least 50 degrees of rotation of the handle portion relative to the spline shaft.

The charging handles herein can be for an AR style firearm. The first end of the charging handle base can define an opening arranged to receive a portion of a bolt carrier group of the firearm.

BRIEF DESCRIPTION OF THE DRAWINGS

FIG. 4A is a top view of an M16 type charging handle.

FIG. 4B is a right side view of the charging handle of FIG. 4A.

FIG. 4C is a left side view of the charging handle of FIG. 4A.

FIG. 4D is an end view of the charging handle of FIG. 4A.

FIG. 5A is a top view of an M16 type upper receiver.

FIG. 5B is a right side view of the upper receiver of FIG. 5A.

FIG. 5C is an end view of the upper receiver of FIG. 5A.

FIG. 6A is a partial cutaway top view of the charging handle of FIG. 4A inserted in the forward position in the upper receiver of FIG. 5A.

FIG. 6B is a side view of the assembly of FIG. 6A.

FIG. 6C is an end view of the assembly of FIG. 6A.

FIG. 8 is an exploded view of a charging handle of the present disclosure.

FIG. 9 is a top view of the charging handle of FIG. 8.

FIG. 10 is a top view of the charging handle of FIG. 9 in a forward position in an upper receiver.

FIG. 33A is a top view of a charging handle base.

FIG. 33B is a left side view of the charging handle base of FIG. 33A.

FIG. 33C is an end view of the charging handle base of FIG. 33A.

FIG. 33D is a right side view of the charging handle base of FIG. 33A.

FIG. 33E is a bottom view of the charging handle base of FIG. 33A.

FIG. 34A is a top view of a charging handle base with the latch-spring pocket and latch-slot shown in phantom.

FIG. 34B is an end view of the charging handle base of FIG. 34A.

FIGS. 34C and 34D are side views of the charging handle base of FIG. 34A.

FIG. 34E is a bottom view of the charging handle base of FIG. 34A.

FIG. 35 is an end view of a charging handle base.

FIG. 36 is a cross-sectional view along line 36-36 of FIG. 35.

FIG. 68 is a partial sectional plan view of the charging handle assembled into a receiver, with the load portion having rotated fully forward, and the charging handle having moved rearward away from the receiver.

FIG. 69 is a partial sectional plan view of the charging handle with the cam-lug resetting.

FIG. 70 is a partial sectional plan view of the charging handle with the latch being actuated manually.

FIG. 73A is a top view of another embodiment of a lever.

FIG. 73B is an end view of the lever of FIG. 73A.

FIG. 73C is a side view of the lever of FIG. 73A.

FIG. 73D is an end view of the lever of FIG. 73A.

FIG. 74A is a top view of the lever of FIG. 73A assembled on a charging handle base.

FIG. 74B is an end view of the assembly of FIG. 74A.

FIG. 74C is a side view of the assembly of FIG. 74A.

FIG. 75 is a top view of a lever actuating a charging handle latch.

DESCRIPTION OF THE SELECTED EMBODIMENTS

Figure 1:
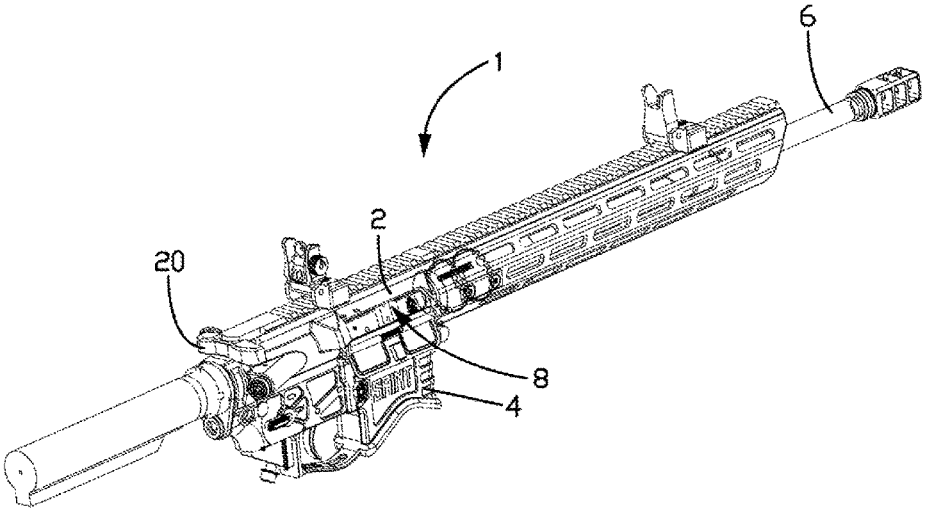
FIG. 1 is a perspective view of a firearm with a charging handle in a forward position.

For the purpose of promoting an understanding of the principles of the present disclosure, reference will now be made to the embodiments illustrated in the drawings and specific language will be used to describe the same. It will nevertheless be understood that no limitation of the scope of the present disclosure is thereby intended. Any alterations and further modifications in the described embodiments, and any further applications of the principles of the present disclosure as described herein are contemplated as would normally occur to one skilled in the art to which the invention relates. One embodiment of the invention is shown in detail, although it will be apparent to those skilled in the relevant art that some features that are not relevant to the present invention may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "upper", "lower", "bottom", "forward", "rearward" and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

The charging handle arrangements disclosed herein can be applied to any number of firearm types; however, it is envisioned the AR family of firearm (e.g., AR-15 and M16) will most readily benefit from such devices. With this in mind, the charging handles illustrated herein are described with reference to an unmodified AR-15 type upper receiver. Specifically, a flat-top AR-15 type upper receiver with a Picatinny Rail. However, this should not be considered limiting.

For the purposes of the Description, friction is acknowledged as a practical design factor, but is ignored (except where noted) in this document as not being required for understanding the principles of the invention.

Figure 2:
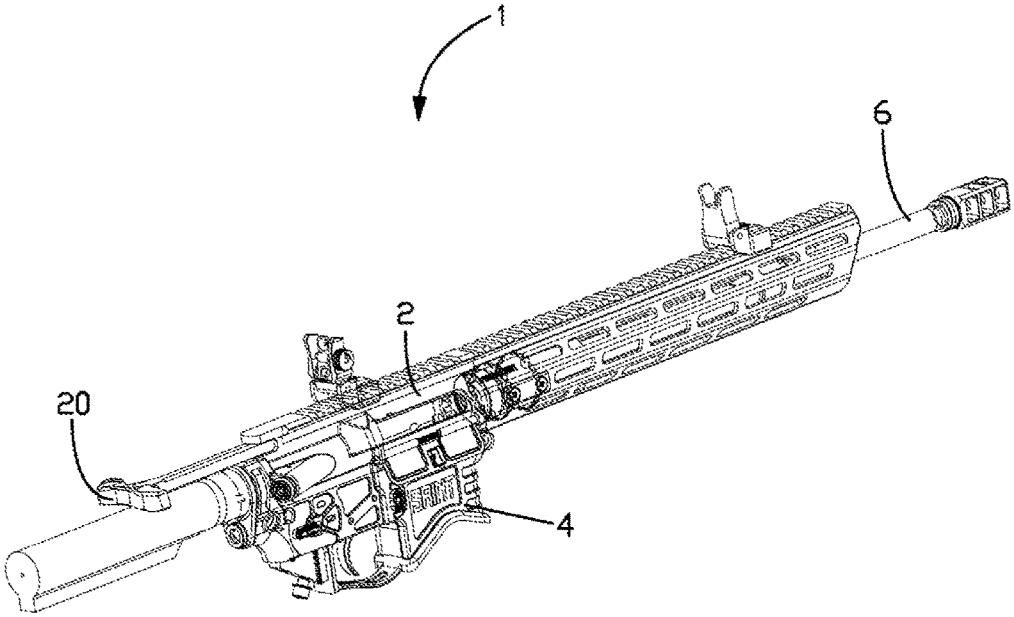
FIGS. 2 and 3 are perspective views of the firearm of FIG. 1 with the charging handle in a rearward position.
Figure 3:
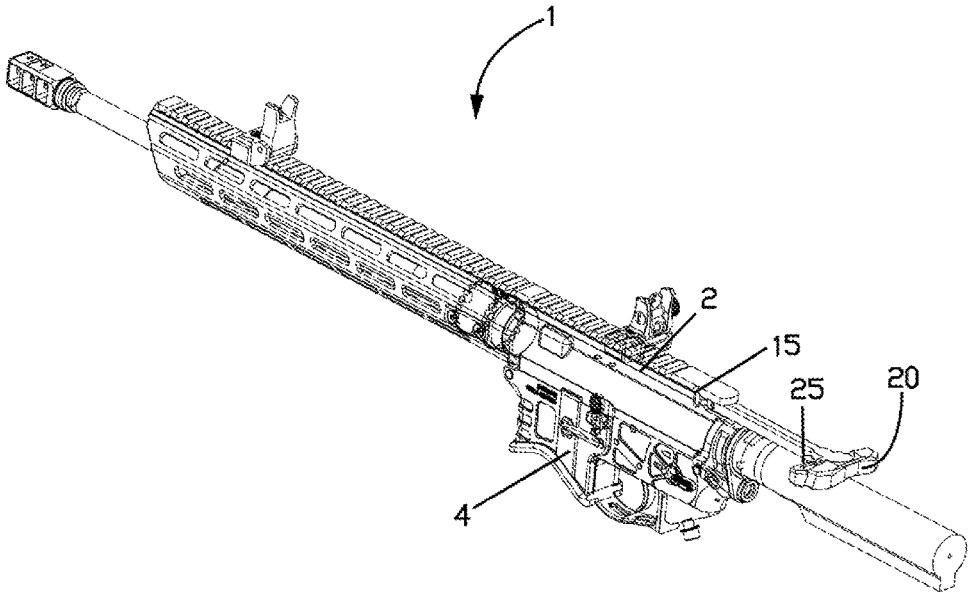

FIG. 1 illustrates an AR style firearm 1 having an upper receiver 2, a lower receiver 4, a barrel 6, a bolt carrier group 8, and a charging handle 20 in a forward, latched position. FIGS. 2 and 3 illustrate the firearm 1 with the charging handle 20 and bolt carrier group 8 of FIG. 1 in a rearward position. The firearm includes a receiver notch 15 that receives a charging handle latch 25 when the charging handle is in the forward, latched position. When the charging handle latch 25 is engaged with the receiver notch 15, the charging handle is retained in the forward position.

As shown in FIGS. 4A-D, existing charging handles 20 include a charging handle latch 25 that resides within a latch-slot 22 of a charging handle base 24. The charging handle 20 has a latch-retainer hole 23 and a latch-spring pocket 27 (the spring is not shown). Charging handle-latch 25 pivots about a retaining pin (not shown) fitted into latch-retainer hole 23 so that the charging handle-latch can be rotated to selectively engage and disengage from receiver notch 15.

As shown in FIGS. 5A-C, an upper receiver 10 can be equipped with a receiver-rail 35. Receiver-rail 35 is depicted here in the 1913 Picatinny rail configuration; however, other configurations are envisioned, such as other rail systems and/or an integral carry handle, as are other types/makes/models of firearms. A rearward portion of the upper receiver (e.g., end of receiver-rail 35) has a rearward-facing surface 30. As illustrated in FIG. 5A, the rearward-facing surface can be a rounded, rearward-facing surface of receiver-rail 35.

FIGS. 6A-6C illustrate charging handle 20 received in upper receiver 10 in a forward, latched position. As can be seen, charging handle 20 fits inside receiver 10, beneath receiver-rail 35, with latch 25 engaged in receiver notch 15.

Figure 7:
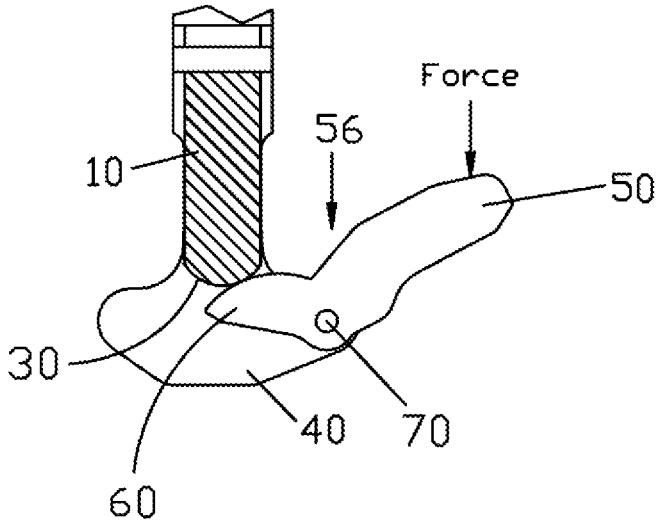
FIG. 7 is a top view of a novel charging handle in a forward position in an upper receiver.

In contrast to the charging handles shown in the previously discussed figures, novel charging handles disclosed herein advantageously provide a mechanical advantage (e.g., leverage) to force the charging handle rearward. Turning now to specific embodiments of the present disclosure, the charging handle can include a lever arranged to contact a portion of the firearm to force the charging handle rearward. FIG. 7 illustrates an embodiment wherein the charging handle includes a lever 56 pivotably coupled to the novel charging handle base 40 through a shaft 70.

In FIG. 7, the lever 56 functions as a first-class lever relative to the charging handle base 40. When a force is exerted on a handle portion 50 (e.g., a handle) of lever 56, a load portion 60 (e.g., a cam) of lever 56 applies a force to rearward-facing surface 30 (of FIGS. 5A-5B) of the firearm to separate the charging handle from the firearm.

FIG. 8 illustrates an exploded view of an embodiment of a charging handle 38 having lever comprising a handle portion 50 that is selectively pivotable relative to a load portion 60. In FIG. 8, the charging handle base 40 defines a spline pivot hole 45 that rotatably and reciprocatingly receives a spline shaft 70. Similarly, load portion 60 defines a cam spline hole 65 and handle portion 50 defines a handle spline hole 55. Each of the cam spline hole and the handle spline hole are arranged to reciprocatingly receive the spline shaft.

Spline shaft 70 has splines extending longitudinally there along. For example, spline shaft 70 can have a land 75, which can be wider than the other spline-lands. As will be appreciated by one skilled in the art, the size/shape/number/configuration/orientation/etc. of the spline lands are not limited to the configuration shown. For example, a spline shaft with a single land is envisioned.

Still referring to FIG. 8, where load portion 60 with cam spline hole 65 can be seen, cam spline hole 65 is configured to accept spline shaft 70. Cam spline hole 65 has cam spline gap 61. Cam spline gap 61 is configured to accept land 75 of spline shaft 70. Land 75, being too large to do otherwise, will only assemble with cam spline gap 61. Advantageously, alignment provided by spline land 75 and cam spline gap 61 can aid in the proper alignment of the components during assembly of the mechanism.

Unlike spline shaft 70 and cam spline hole 65 that each have only one larger spline or spline gap in their spline configuration, handle spline hole 55 of handle portion 50 can have multiple. A first lever spline gap 51 and a second lever spline gap 52 of handle spline hole 55 will both accept land 75 of spline shaft 70. For example, handle spline hole 55 can be configured to accept spline shaft 70, with land 75, in two orientations. These two orientations correspond to handle portion 50 being in either a stowed position or a deployed position. In some instances, handle spline hole 55 may only accept spline shaft 70 in the two orientations described above. For example, land 75, of spline shaft 70 may be configured to prevent spline shaft 70 from engaging with spline hole 55 in any orientation other than the stowed position or the deployed position.

Referring now to FIG. 9, which is a plan view of the basic components of the charging handle 38 (of FIG. 8) assembled together. In this view spline pivot hole 45, in novel charging handle base 40, is no longer visible. Spline shaft 70 is assembled into spline pivot hole 45. Spline shaft 70 is free to rotate within spline pivot hole 45. Spline shaft 70 extends down through spline pivot hole 45. Spline shaft 70 also extends up through cam spline hole 65 of load portion 60 and through handle spline hole 55 of handle portion 50. The spline lands of spline shaft 70 are engaged with the spline teeth of cam spline hole 65 of load portion 60. The spline lands of spline shaft 70 are also engaged with the spline teeth of handle spline hole 55 of handle portion 50. Engaged in this way, spline shaft 70, load portion 60 and handle portion 50 will all rotate together. In this figure, handle portion 50 is depicted in the deployed position, with land 75, of spline shaft 70, engaged with first lever spline gap 51.

FIG. 10 is a plan view of the basic components of the charging handle 38 assembled together and shown in the fully forward position within receiver 10. In this view the proximity of load portion 60 to rearward-facing surface 30 can be seen.

Figure 11:
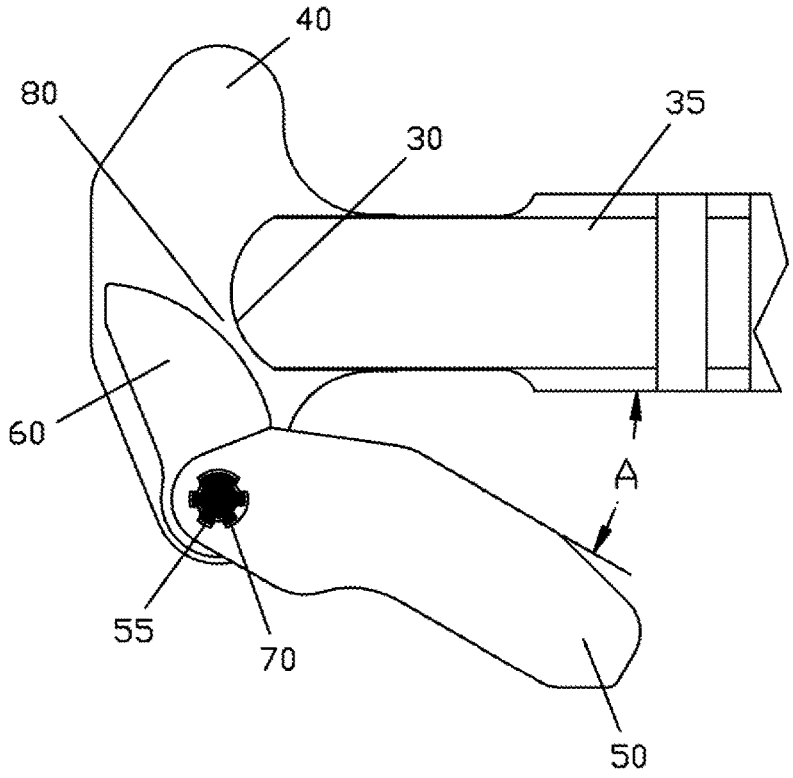
FIG. 11 is a top view close-up of the end of the assembly of FIG. 10.

FIG. 11 is a close-up view of the charging handle as depicted in FIG. 10, with some details of receiver 10 being omitted for clarity. In this view, handle portion 50 is shown in the fully deployed position, with angle "A" at its most acute angle. Also, the engagement of the spline lands of spline shaft 70 with the spline teeth of handle spline hole 55 can be more clearly seen.

In FIG. 11, load portion 60 is not yet in contact with rearward-facing surface 30, having cam-gap 80 between them. Cam-gap 80 is not necessary for the functioning of the camming components of the charging handle. However, cam-gap 80 can aid by providing tolerance for proper operation and functioning of the handle-latch.

Figure 12:
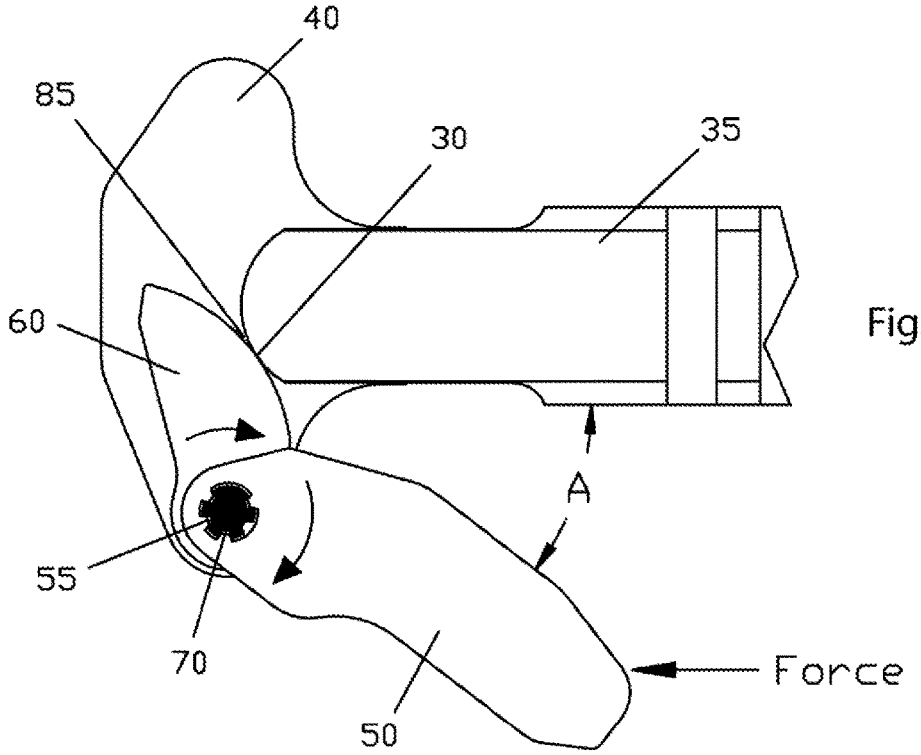
FIGS. 12, 13, 14, 15, and 16 illustrate operation of the charging handle of FIG. 10.

In FIG. 12, angle "A" has increased slightly, cam-gap 80 is closed, and load portion 60 is now in contact with rearward-facing surface 30 at contact point 85. This may be the configuration upon application of a rearward force to handle portion 50. Handle portion 50, being engaged to spline shaft 70 via handle spline hole 55, has transmitted the rearward force to spline shaft 70. Spline shaft 70 being pivotally mounted within spline pivot hole 45 (of FIG. 8) has converted the rearward force into a rotational force. Spline shaft 70, also being engaged to load portion 60 via cam spline hole 65 (of FIG. 8), has, in turn, also transmitted the force to load portion 60, causing load portion 60 to rotate slightly.

FIGS. 13-16 illustrate a progression of charging handle displacement when the charging handle is separating from the firearm. In these figures, rearward-facing surface 30 is shown as being stationary while novel charging handle base 40 is considered as being movable.

Figure 13:
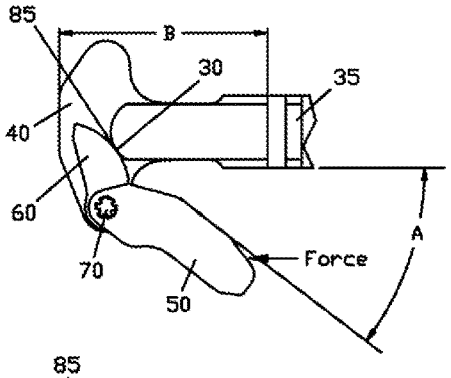
Figure 14:
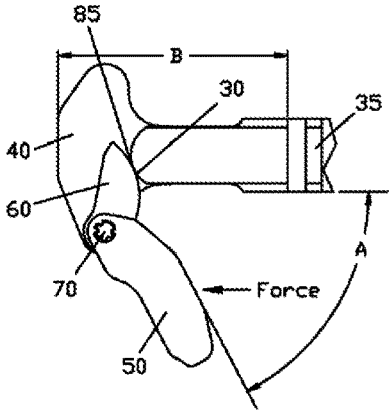
Figure 15:
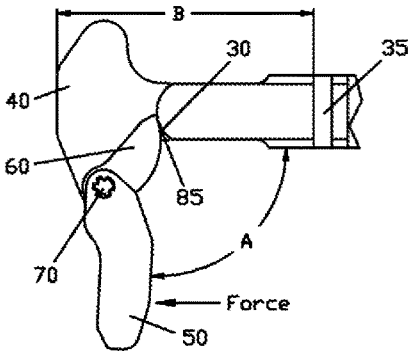

FIGS. 13-15 depict the force-multiplier aspect of the charging handle as force is applied to handle portion 50. For example, as a rearward force is applied to handle portion 50, handle portion 50 communicates that rearward force to spline shaft 70. Spline shaft 70 being pivotally mounted in spline pivot hole 45 (not shown), of novel charging handle base 40, converts the rearward force into a clockwise rotational force. Because load portion 60 is also connected/splined to spline shaft 70, load portion 60 also receives the clockwise rotational force. Load portion 60, being rotated by the clockwise rotational force comes into contact with rearward-facing surface 30, at contact point 85. Contact point 85 of rearward-facing surface 30 exerts a longitudinal/rearward reaction force against load portion 60 that is applied back to spline shaft 70. Spline shaft 70, being mounted in spline pivot hole 45 of novel charging handle base 40, transmits this longitudinal/rearward reaction force to novel charging handle base 40 so as to force novel charging handle base 40 in a rearward direction.

In FIGS. 13-15, it can be seen that the circumferential distance handle portion 50 rotates through angle "A" is greater than the longitudinal distance B that novel charging handle base 40 moves. This demonstrates the force applied to handle portion 50 is increased in mechanical advantage through the employment of leverage. Also, it should be noted that, under a static analysis, the rearward force applied by a user to the handle portion 50 is cumulative with the rearward force exerted on the charging handle 38 by the rearward-facing surface 30. In other words, the rearward force applied to handle portion 50 is not just functioning the charging handle mechanism. Rather, the initial force is, itself, helping to push the charging handle rearward.

Referring again to FIG. 13, which depicts the charging handle's components in the same orientations/positions as FIG. 12, a rearward force is being applied to handle portion 50, and load portion 60 has rotated into contact with rearward-facing surface 30. Angle "A" has increased slightly from its starting location (as shown in FIG. 11), but distance-B is still at its minimum value.

In FIG. 14, the rearward force being applied to handle portion 50 has caused handle portion 50, spline shaft 70 and load portion 60 to rotate and partially extract the charging handle 38 from the firearm. As can be seen relative to FIG. 13, angle "A" has increased and distance B has now also increased.

Referring now to FIG. 15, the rearward force applied to handle portion 50 has caused handle portion 50, spline shaft 70 and load portion 60 to rotate further. Relative to FIG. 14, angle "A" is shown as having increased and distance B has once again increased.

The profile of load portion 60 (e.g., the cam) of lever 56 can be configured for specific contact between load portion 60 and rearward-facing surface 30. For example, load portion 60 may have a cam profile. In some instances, the cam profile is curved so that the point of contact with rearward-facing surface is approximately orthogonal (±20 degrees) to the longitudinal axis of the charging handle base throughout the movement of the pivot axis of the load portion (e.g., the spline shaft) away from the rearward-facing surface. For example, the cam profile may resemble a Fibonacci spiral. Advantageously, such arrangements can reduce the total force required to be applied to the charging handle and upper receiver to achieve a desired force in the rearward direction.

The location of contact point 85 may move throughout the charging handle's function. For example, as shown in FIGS. 13-15, the location of contact point 85 varies during operation of the charging handle. Such an arrangement can be achieved by configuring the shape of load portion 60. For example, load portion 60 can have an arcuate surface so that as the load portion rotates around spline shaft 70, which moves away from rearward-facing surface 30, the load portion slides across a portion of rearward-facing surface 30.

It is envisioned that load portion 60 may have a cam profile that would result in load portion 60 contacting rearward-facing surface 30 at the same point throughout charging handle operation. For example, the cam profile can be arranged so that the point of contact with the rearward-facing surface is vertically aligned with a central longitudinal axis of the charging handle substantially throughout the movement of the charging handle rearward. Advantageously, such arrangements can reduce the torque experienced by the charging handle when the charging handle is applying a particular force to the rearward facing surface.

Conversely, it is also envisioned that load portion 60 may have a cam profile that would result in load portion 60 continually rolling over rearward-facing surface 30 in a 1:1 ratio. In this way all sliding friction would be eliminated. This would have the advantage of spreading out any damage suffered by the surfaces during operation, while greatly reducing friction.

Additionally or alternatively, some form of roller-bearing could be employed between load portion 60 and rearward-facing surface 30. Also, low friction materials (such as Nylon, Teflon, etc.) could be employed to further reduce friction.

Figure 16:
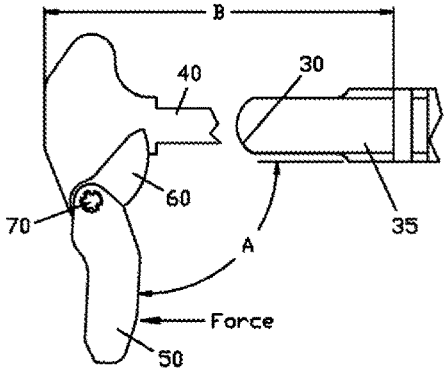

In FIG. 16, the charging handle has completed the improved mechanical-advantage phase, and now novel charging handle base 40 continues rearward in the conventional fashion, completing the bolt opening process.

Figure 17:
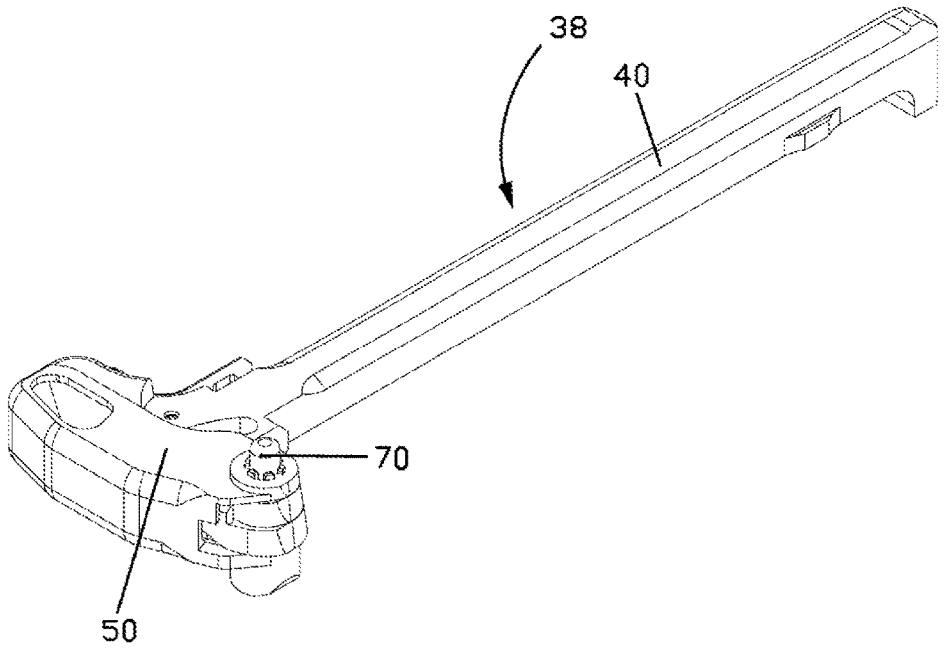
FIG. 17 is a perspective view of a charging handle in a stowed configuration with a spline shaft in an upper position.
Figure 18:
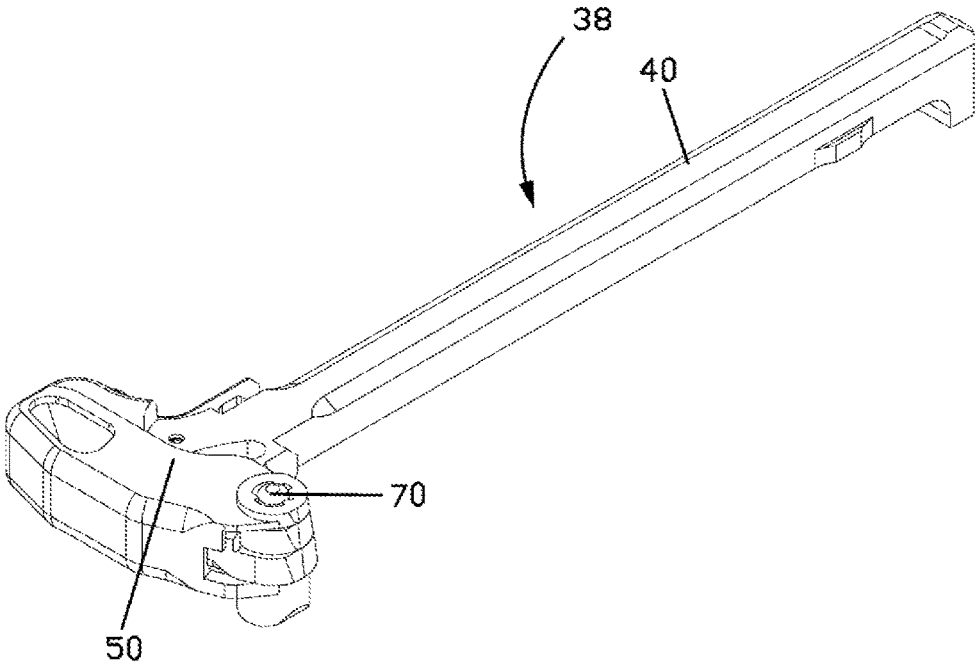
FIG. 18 is a perspective view of the charging handle of FIG. 17 with the spline shaft in a lower position.
Figure 19:
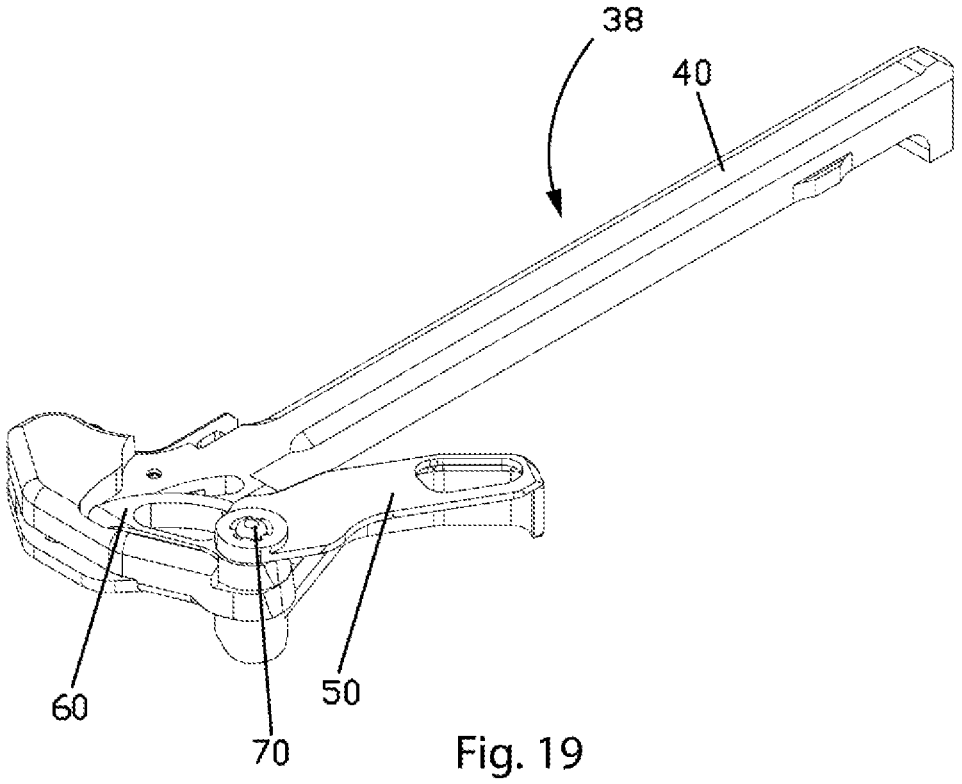
FIG. 19 is a perspective view of the charging handle of FIG. 18 in a deployed configuration.
Figure 20:
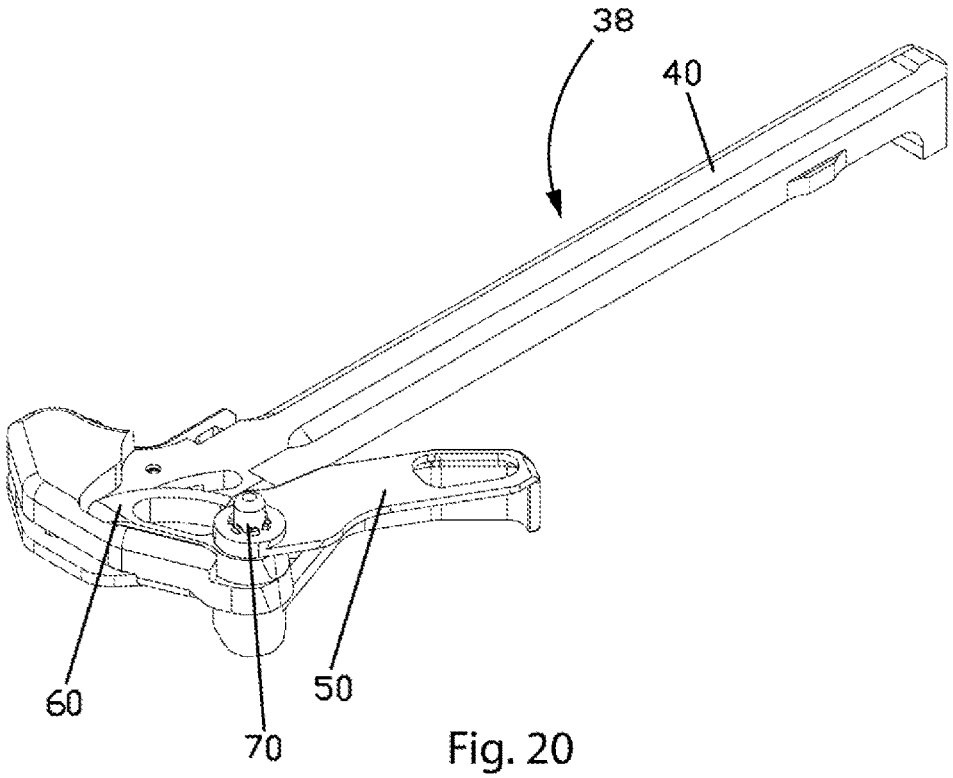
FIG. 20 is a perspective view of the charging handle of FIG. 19 with the spline shaft in an upper position.

FIGS. 17-20 illustrate a process of configuring handle portion 50 from a stowed configuration to a deployed configuration that is usable for leveraging. In FIG. 17, handle portion 50 extends along a rearward end of charging handle base 40. In FIG. 18, spline shaft 70 is depressed so as to disengage the splines of spline shaft 70 from spline teeth and gaps of handle spline hole 55. When spline shaft 70 is disengaged from the spline teeth and the gaps of the handle spline hole 55, handle portion 50 may be rotated to the deployed configuration, as shown in FIG. 19. When in the deployed configuration, spline shaft 70 can be allowed to return to an upper position, such as under the force of spring bias, to engage one or more splines of spline shaft 70 with the spline teeth and the gaps of handle spline hole 55, as shown in FIG. 20. When the one or more splines of the spline shaft 70 are engaged with the spline teeth and gaps of handle spline hole 55 and cam spline hole 65, actuation of handle portion 50 rotates spline shaft 70 which, in turn, rotates load portion 60. To configure the charging handle from the deployed configuration to the stowed configuration, the process can be reversed (i.e., depressing spline shaft 70 in the configuration illustrated in FIG. 20, rotating the lever to the stowed configuration, and allowing spline shaft 70 to return to the upper position).

Figure 21:
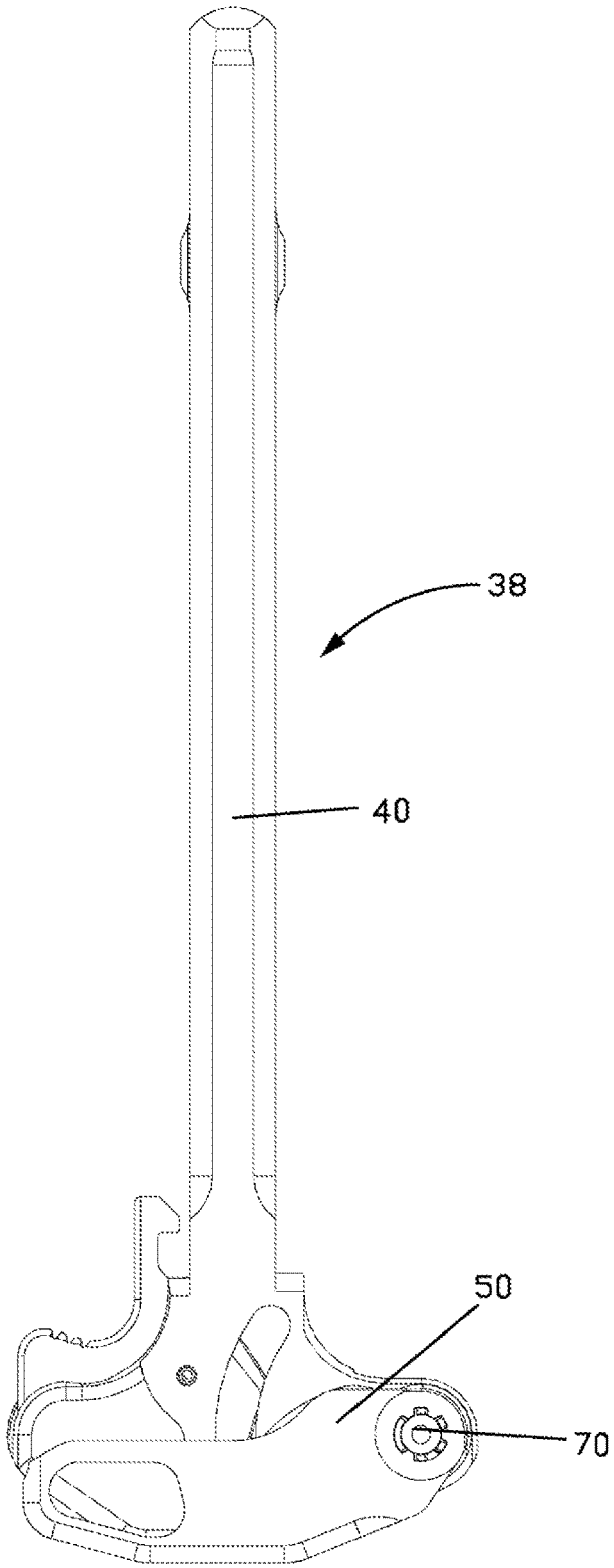
FIG. 21 is a top view of the charging handle of FIG. 17.
Figure 22:
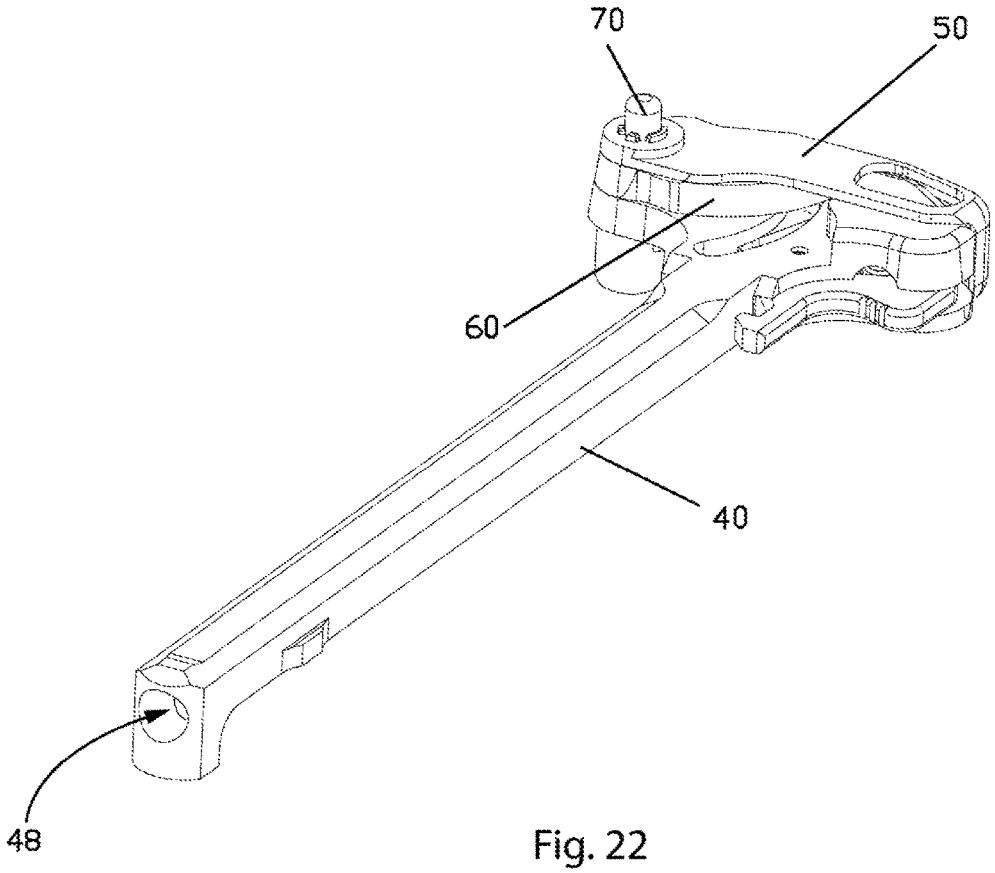
FIG. 22 is a perspective view of the charging handle of FIG. 17.
Figure 23:
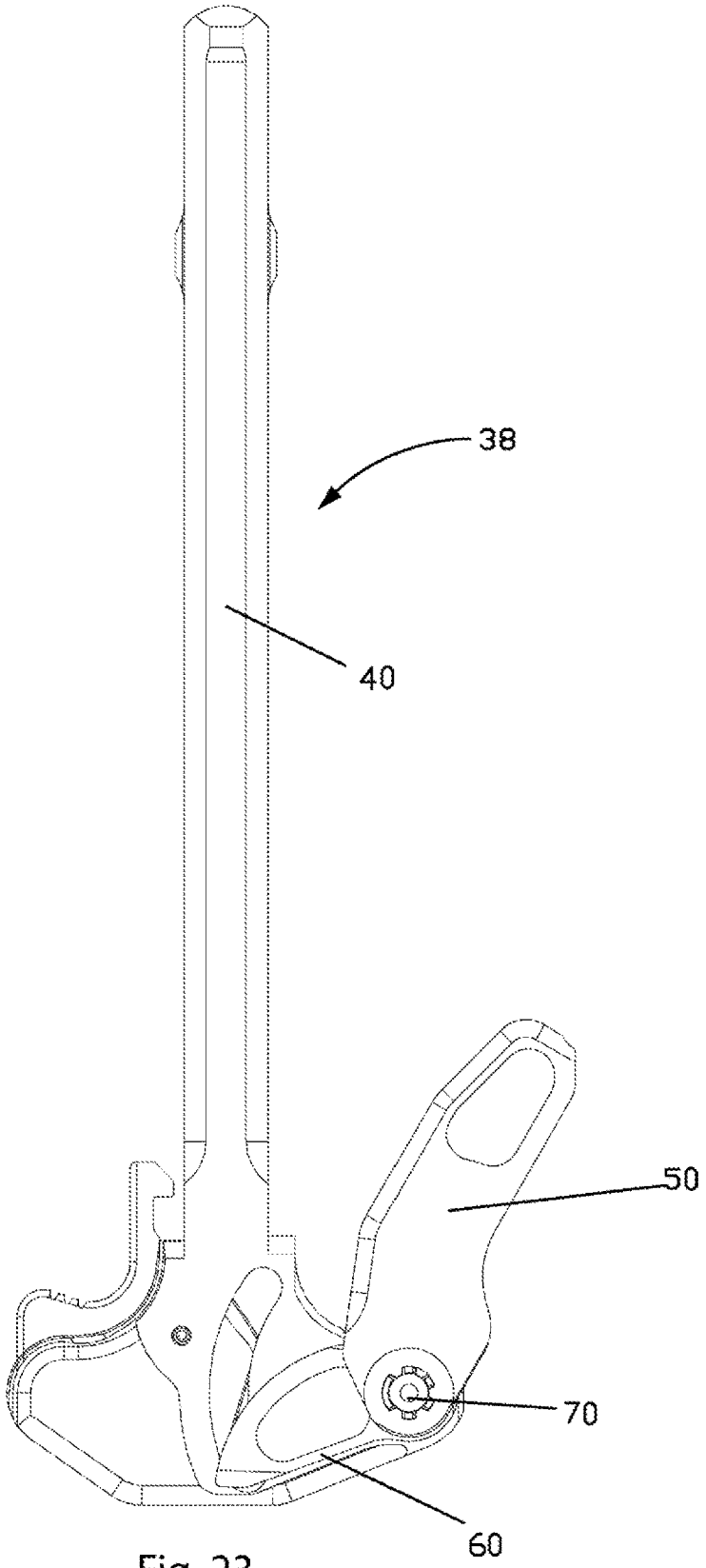
FIG. 23 is a top view of the charging handle of FIG. 20.
Figure 24:
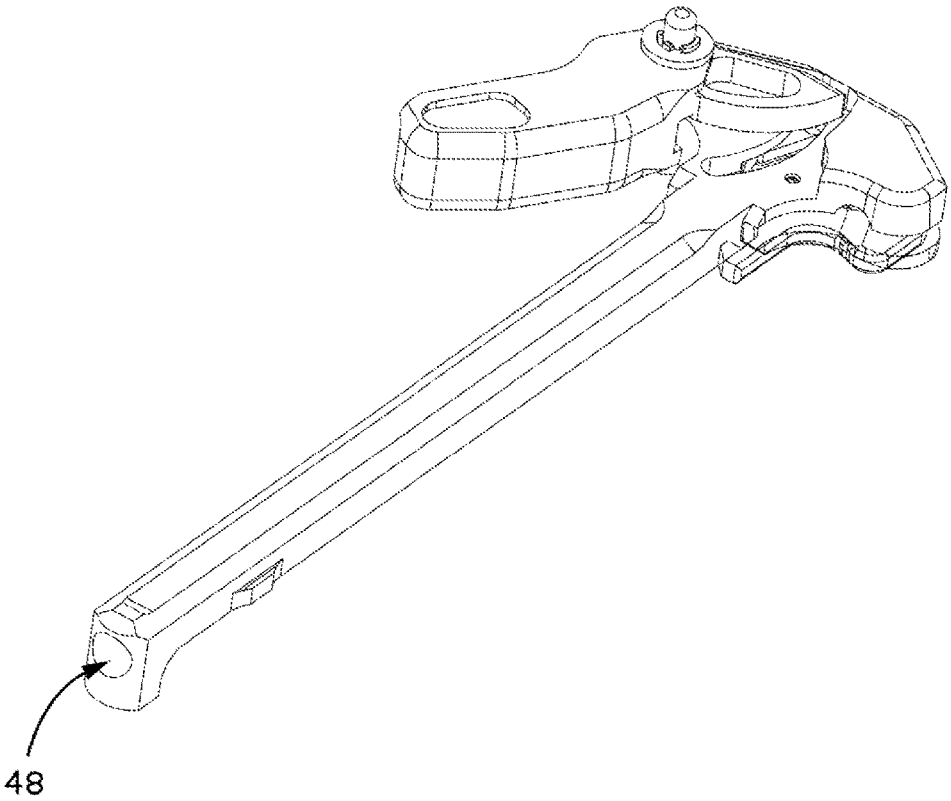
FIG. 24 is a perspective view of the charging handle of FIG. 20.

FIGS. 21 and 22 illustrate additional views of a charging handle with handle portion 50 in a stowed configuration. FIGS. 23 and 24 illustrate additional view of a charging handle with handle portion 50 in a deployed configuration. FIGS. 22 and 24 also illustrate other features of charging handle 38, such as an opening 48 arranged to receive a gas key and/or a piston associated with a bolt carrier group of the firearm.

Figure 25:
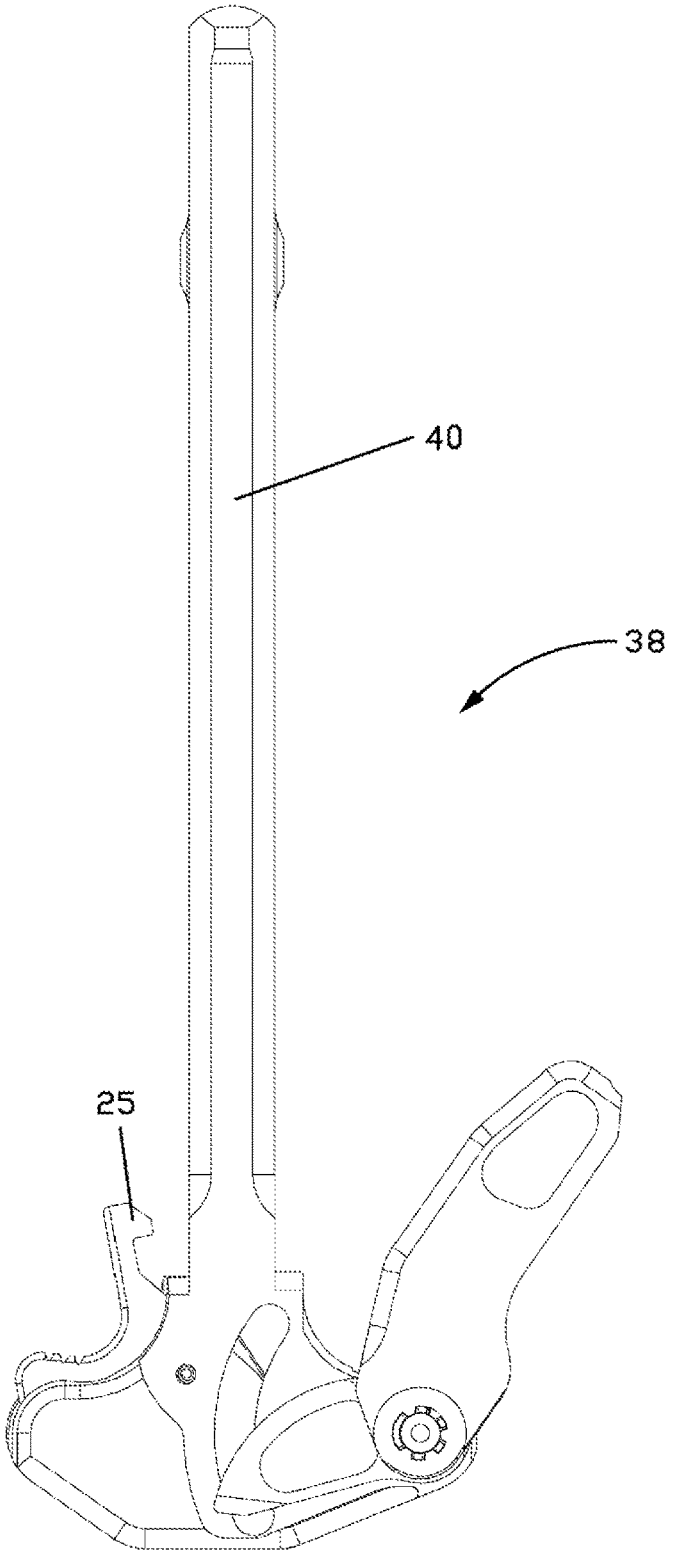
FIG. 25 is a top view during operation of the charging handle of FIG. 20.

FIG. 25 illustrates that lever 56 can actuate charging handle latch 25, in at least some embodiments, in response to actuation of handle portion 50. In comparison to FIG. 23, handle portion 50, load portion 60, and spline shaft 70 have rotated relative to the position shown in FIG. 25. As can be seen, charging handle latch 25 has pivoted away from charging handle base 40 in FIG. 25.

A more detailed description of how the charging handle is configurable from the stowed configuration to the deployed configuration, and vice versa, is described in the following figures. Additionally, further description as to how the lever 56 actuates the charging handle latch is further described below.

Figure 26:
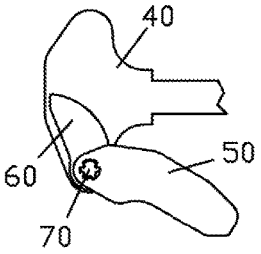
FIGS. 26, 27, 28, and 29 illustrate top views of a charging handle configurable from a deployed configuration to a stowed configuration.
Figure 27:
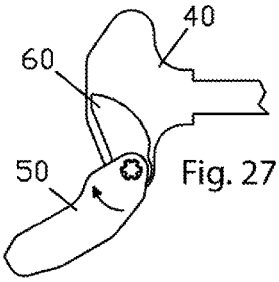
Figure 29:
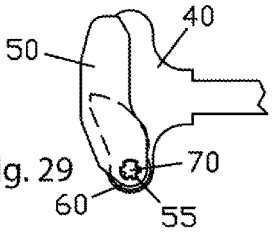
Figure 30:
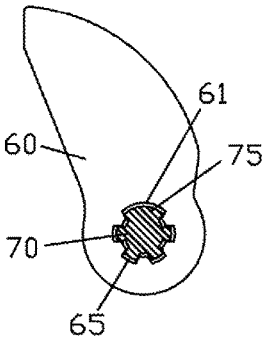
FIG. 30 is a top view of a load portion and a spline shaft assembled together.
Figure 31:
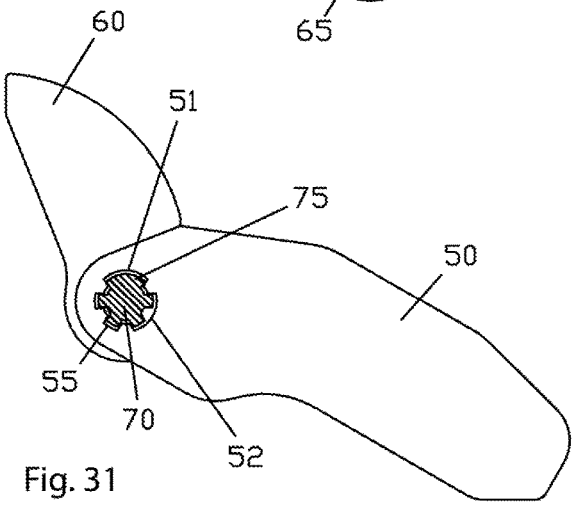
FIG. 31 is a top view of the load portion and spline shaft of FIG. 30 assembled with a handle portion in a deployed configuration.
Figure 32:
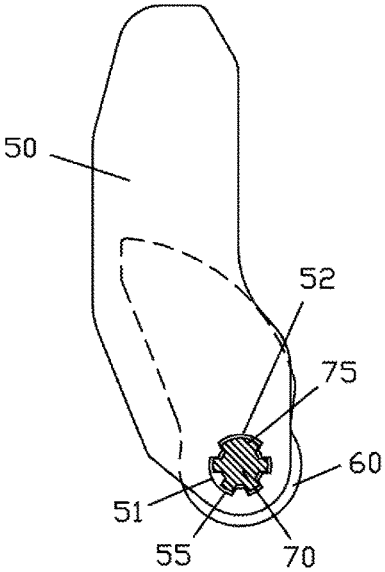
FIG. 32 is a top view of the assembly of FIG. 31 in a stowed configuration.
Figure 37A:
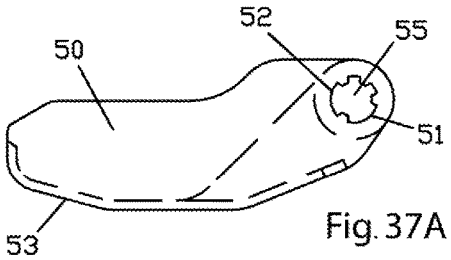
FIG. 37A is a top view of a handle portion of a lever.
Figure 37B:
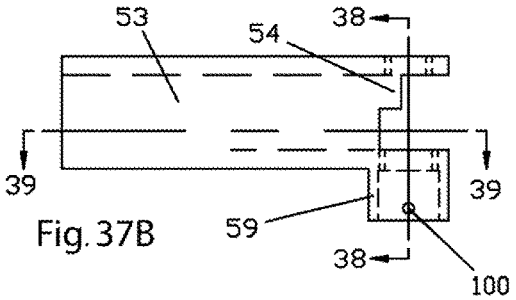
FIG. 37B is a side view of the handle portion of FIG. 37A.
Figure 37C:
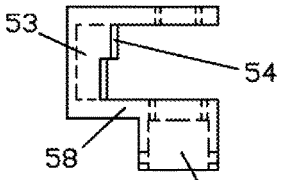
FIG. 37C is an end view of the handle portion of FIG. 37A.
Figure 37D:
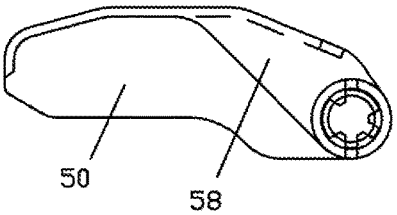
FIG. 37D is a bottom view of the handle portion of FIG. 37A.
Figure 38:
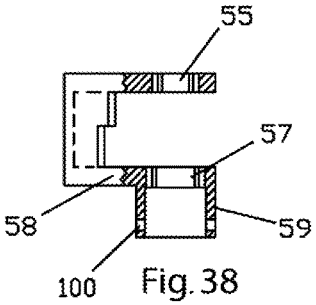
FIG. 38 is a cross-sectional view along line 38-38 of FIG. 37B.
Figure 39:
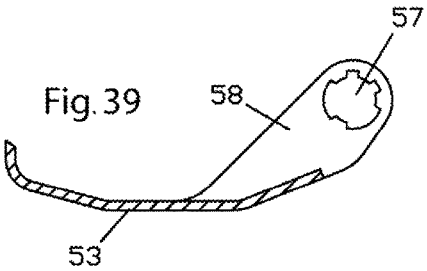
FIG. 39 is a cross-sectional view along line 39-39 of FIG. 37B.
Figure 40:
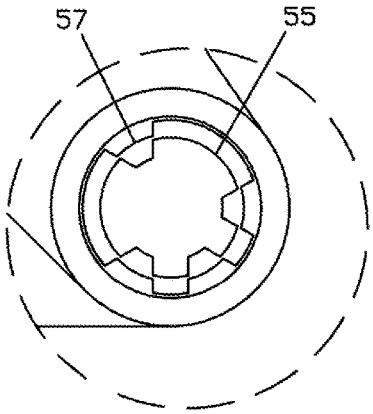
FIG. 40 is a close-up of the handle spline hole of FIG. 37D.
Figure 41A:
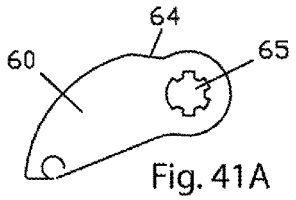
FIG. 41A is a top view of a load portion (e.g., a cam) of a lever.
Figure 41B:
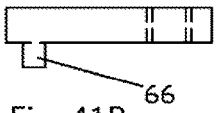
FIG. 41B is a back side view of the load portion of FIG. 41A.
Figure 41C:
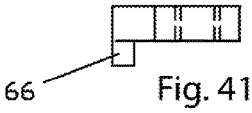
FIG. 41C is an end view of the load portion of FIG. 41A.
Figure 41D:
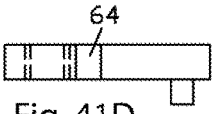
FIG. 41D is a front side view of the load portion of FIG. 41A.
Figure 41E:
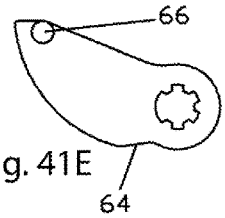
FIG. 41E is a bottom view of the load portion of FIG. 41A.

Referring now to FIGS. 26-32, the process of stowing handle portion 50 is shown. In these figures, it is assumed that load portion 60 is being held stationary. In FIGS. 26-32, the spline teeth of load portion 60 have been removed for clarity. For example, FIG. 30 shows the spline teeth of cam spline hole 65. This has been done to more clearly show the relationship of the spline lands of spline shaft 70 to the spline teeth of handle spline hole 55, of handle portion 50. Additionally, in FIGS. 30-32 novel charging handle base 40 has been removed for clarity so the details discussed in FIG. 26-29 can be more clearly seen. FIG. 31 is a simplified view of FIG. 26, and FIG. 32 is a simplified view of FIG. 29.

In FIGS. 26 and 31, handle portion 50 is shown in the fully deployed position. In these figures, spline shaft 70 extends down into spline pivot hole 45 (not shown) of novel charging handle base 40. Spline shaft 70 extends up through cam spline hole 65 of load portion 60. Spline shaft 70 also extends up into handle spline hole 55 of handle portion 50. The spline lands of spline shaft 70 are engaged with the spline teeth of cam spline hole 65 and handle spline hole 55. Spline shaft 70 is free to reciprocate within spline pivot hole 45 and cam spline hole 65 and handle spline hole 55.

Figure 28:
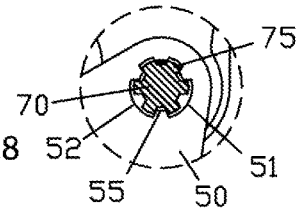

FIG. 28 illustrates handle portion 50 in an intermediate position between deployed and stowed. Before handle portion 50 is rotated relative to load portion 60, spline shaft 70 is disengaged from handle portion 50. For example, spline shaft 70 being free to reciprocate can be depressed sufficiently to drop below the level of handle portion 50. In other words, spline shaft 70 has been pushed down under handle portion 50 to disengage spline shaft 70 from handle portion 50. Disengaging spline shaft 70 from handle portion 50 allows handle portion 50 to freely rotate relative to spline shaft 70 and, therefore, load portion 60 and novel charging handle base 40.

Once handle portion 50 has begun to rotate toward the stowed position, or vice versa, spline shaft 70 is prevented from re-engaging with handle portion 50 until handle portion 50 is in the fully stowed (or fully deployed) position. FIG. 28 shows more clearly how land 75 of spline shaft 70 interferes with the spline teeth of handle spline hole 55. As can be seen, land 75 of spline shaft 70 is too wide to engage with any other spline gap of handle spline hole 55 except first lever spline gap 51 and second lever spline gap 52. For example, spline shaft 70 with land 75 can be arranged to only re-engage with handle spline hole 55 once handle portion 50 is rotated sufficiently to either bring first lever spline gap 51 or second lever spline gap 52 back into alignment with land 75.

Embodiments using a symmetrical spline are envisioned; however, such embodiments may require an operator to manually hold spline shaft 70 down until handle portion 50 is fully rotated into the desired position.

In FIGS. 29 and 32, handle portion 50 has rotated to the fully stowed position. In this position, spline shaft 70 with land 75 can now re-engage with handle spline hole 55 of handle portion 50 because second lever spline gap 52 is in alignment with land 75. This can be more clearly seen in FIG. 32.

The engagement of spline shaft 70 to load portion 60 can be clearly seen in FIG. 30 (handle portion 50 has been removed for clarity). This view clearly shows land 75 of spline shaft 70 is too wide to be positioned in any spline gap in cam spline hole 65, other than cam spline gap 61. It should be noted that spline shaft 70 may not disengage from load portion 60 at any point during charging handle operation. For example, unlike handle portion 50 which selectively disengages from spline shaft 70 when handle portion 50 is being either deployed or stowed, load portion 60 may maintain engagement with spline shaft 70 throughout charging handle operation, regardless of the position of handle portion 50. However, even if the spline lands of spline shaft 70 never disengage (rotationally) from the spline teeth of load portion 60, spline shaft 70 is free to reciprocate within cam spline hole 65 of load portion 60.

As stated before, FIG. 31 is a simplified view of FIG. 26, where the details of spline shaft 70 and handle spline hole 55 can be more clearly seen (the teeth of cam spline hole 65 are not shown). In this view, handle portion 50 is depicted in the fully deployed position with land 75, of spline shaft 70, engaged with first lever spline gap 51. In this view it can also be seen that second lever spline gap 52 is configured to allow a different spline land(s) of spline shaft 70 to engage with second lever spline gap 52, albeit without filling the groove between the lands.

As stated before, FIG. 32 is a simplified view of FIG. 29, where the details of spline shaft 70 and handle spline hole 55 can be more clearly seen (the teeth of cam spline hole 65 are not shown). In this view, handle portion 50 is depicted in the fully stowed position with land 75, of spline shaft 70, now engaged with second lever spline gap 52. In this view it can also be seen that first lever spline gap 51 is also configured to allow a different spline land(s) of spline shaft 70 to engage with first lever spline gap 51, albeit without filling the groove between the lands.

While only select embodiments have been illustrated and described, other size/shape/number/configuration/orientation/etc. of the spline lands/teeth are envisioned where spline shaft 70 is prevented from engaging with handle spline hole 55, in handle portion 50, unless/until handle portion 50 is in the desired operational position(s). Additionally, while in the above-discussed figures handle portion 50 is shown as having only two extreme (fully deployed/stowed) positions, it is contemplated to have additional spline gaps that would allow handle portion 50 to be rotationally fixed, relative to the spline shaft, in other positions.

Additionally, spline land 75 and first lever spline gap 51 and second lever spline gap 52 could also be eliminated. For example, a symmetrical spline profile could be employed. This would allow the position(s) of handle portion 50 to be selected/customized by the operator. In this scenario the available positions of handle portion 50 would only be limited by the number of spline lands/teeth. However, in such an embodiment the operator may be required to manually hold spline shaft 70 down while handle portion 50 was being rotated into the desired position.

FIGS. 33A-36 illustrate views of a charging handle base 40 for any of the charging handles 38 disclosed herein. FIGS. 33A-33E are shown without any hidden lines. That is, all the lines shown in FIGS. 33A-33E are ones that would be seen from the outside of the part. Whereas 34A-34E and 35 contain selected hidden lines to better show the relationship of the various features of novel charging handle base 40.

FIGS. 33A-33E illustrate a novel charging handle base 40 having a spline pivot hole 45, a latch-slot 42, a latch-retainer hole 43, and a cam-lug passage 46. Latch-slot 42 and latch-retainer hole 43 serve essentially the same functions as the corresponding features in charging handle 20. That is, latch-slot 42 serves essentially the same function as latch-slot 22, and latch-retainer hole 43 serves essentially the same function as latch-retainer hole 23.

In this particular example, cam-lug passage 46 is configured in the shape of an arc, centered on spline pivot hole 45. Cam-lug passage 46 communicates between the upper surface of novel charging handle base 40 into latch-slot 42. Cam-lug passage 46 allows load portion 60 to interact with latch 90. While in the illustrated example cam-lug passage 46 is configured in the shape of an arc whose radius originates from the center of spline pivot hole 45, those skilled in the art will appreciate the shape/origin of cam-lug passage 46 can have other arrangements. Optionally, cam-lug passage 46 may extend through the thickness of charging handle base 40.

FIGS. 34A-34E illustrate a latch-spring pocket 41. Latch-spring pocket 41 is arranged to retain a latch spring that biases the latch into a position to engage receiver notch 15 of the firearm. In comparison to latch-spring pocket 27 of existing charging handles, latch-spring pocket 41 has been rotated relative to charging handle base 40.

FIGS. 35 and 36 illustrate the interior of latch-slot 42. As can be seen, latch-spring pocket 41 intersects latch-slot 42. Also, as stated before, cam-lug passage 46 can be seen intersecting latch-slot 42.

FIGS. 37A-40 illustrate multiple views of a handle portion 50. Handle portion 50 can have a lever back-strap 53 and lower lever-arm 58. Advantageously, lever back-strap 53 and lower lever-arm 58 greatly increase the strength of handle portion 50. Also, lever back-strap 53 and lower lever-arm 58 provide structure to maintain handle portion 50 in both assembly to, and alignment with, charging handle base 40.

Handle portion 50 may include a lower-arm well 59. Lower-arm well 59 can contains a second set of spline teeth in large diameter spline hole 57. Advantageously, the addition of a second set of splines can increase the strength of handle portion 50. For clarity, large diameter spline hole 57 is shown as having a similar spline tooth configuration as handle spline hole 55; however, large diameter spline hole 57 may have a symmetrical spline tooth arrangement for greater engagement area and/or strength. For example, large diameter spline hole 57 may have all of its teeth (i.e. not have the spline gaps that handle spline hole 55 has).

Still referring to FIGS. 37A-40, where interface prong 54 of lever back-strap 53 can be seen, interface prong 54 will interact with load portion 60. Interface prong 54 helps to align the spline teeth of load portion 60 and spline shaft 70 to handle portion 50 when handle portion 50 is fully deployed.

Referring now to FIGS. 41A-41E, load portion 60 can include a cam lug 66. Cam lug 66 is arranged to extend through cam-lug passage 46, of novel charging handle base 40, to interact with latch 90. Cam lug 66 is depicted as being cylindrical; however, other shapes/configurations are envisioned.

Figure 42A:
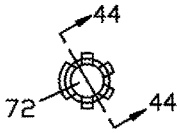
FIG. 42A is a top view of a spline shaft.
Figure 43:
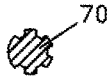
FIG. 43 is a cross-sectional view along line 43-43 of FIG. 42B.
Figure 42B:
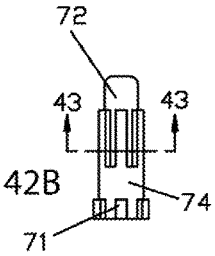
FIG. 42B is a side view of the spline shaft of FIG. 42A.
Figure 42C:
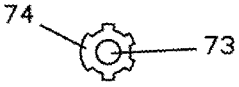
FIG. 42C is a bottom view of the spline shaft of FIG. 42A.
Figure 44:
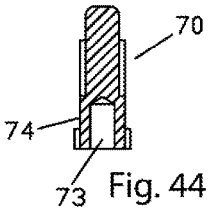
FIG. 44 is a cross-sectional view along line 44-44 of FIG. 42A.

Referring now to FIGS. 42A-42C, spline shaft 70 can have a large diameter spline 71, a spline-button 72, a spline-spring pocket 73 and a cylindrical portion 74. Large diameter spline 71 is configured to selectively engage with large diameter spline hole 57 of handle portion 50. Spline-button 72 is configured to protrude above handle portion 50 to allow the operator to actuate spline shaft 70. Spline-button 72 is configured to fit within the inner-diameter of handle spline hole 55. Spline-spring pocket 73 accepts/retains spline-spring 78 (not shown) that biases spline shaft 70 in an upward position. Cylindrical portion 74 fits within spline pivot hole 45, of charging handle base 40. Advantageously, the interruption of the spline lands at cylindrical portion 74 can provide a continuous surface for the purposes of pivoting within spline pivot hole 45 of charging handle base 40 and, when actuated, large diameter spline 71 of handle portion 50.

Figure 45A:
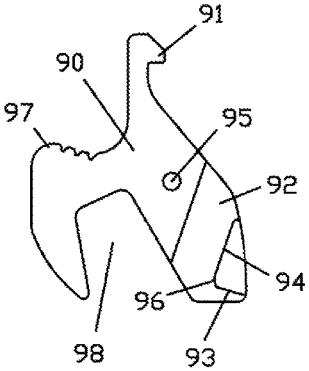
FIG. 45A is a top view of a charging handle latch.
Figure 45C:
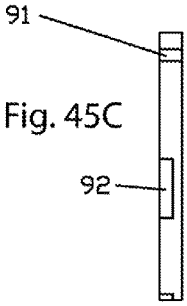
FIG. 45C is a side view of the charging handle latch of FIG. 45A.
Figure 45B:
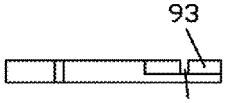
FIG. 45B is an end view of the charging handle latch of FIG. 45A.

Referring now to FIGS. 45A-45C, charging handle latch 90 can be arranged for actuation by cam lug 66 of load portion 60. For example, cam lug 66, of load portion 60, can extend into cam-lug track 92 and interacts with a first latch cam 93, a cam dwell 96 and a second latch-cam 94 to selectively actuate latch 90.

Figure 46A:
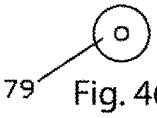
FIG. 46A is a top view of a spline-spring guide.
Figure 46B:
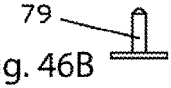
FIG. 46B is a side view of the spline-spring guide of FIG. 46A.
Figure 47A:
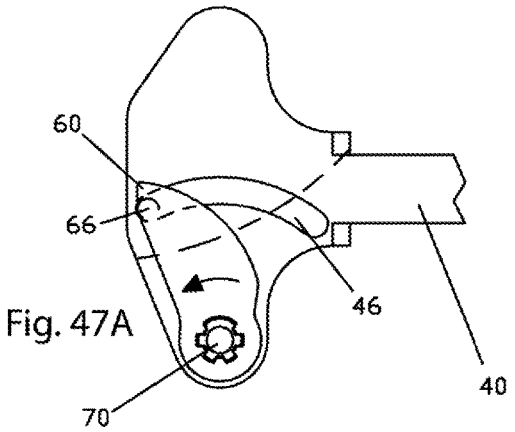
FIG. 47A is a top view of a charging handle, load portion and spline shaft assembled together, with the load portion rotated into its rearward most position.
Figure 47B:
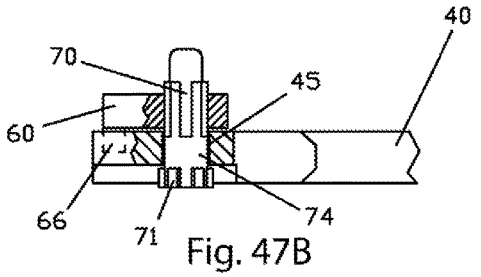
FIG. 47B is a side view of the assembled charging handle, load portion and spline shaft of FIG. 47A.
Figure 47C:
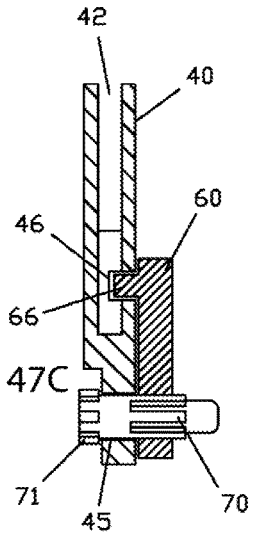
FIG. 47C is an end view of the assembled charging handle, load portion and spline shaft of FIG. 47A.
Figure 48A:
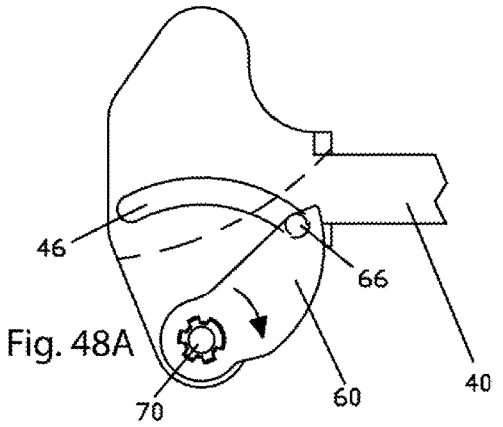
FIG. 48A is top view of a charging handle, load portion and spline shaft assembled together, with the load portion rotated into its forward most position.
Figure 48B:
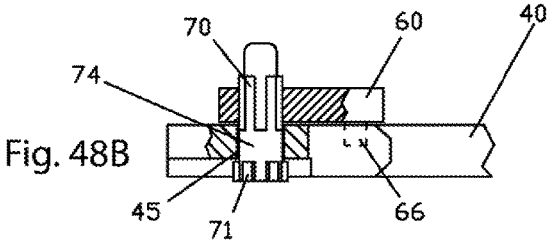
FIG. 48B is a side view of the assembled charging handle, load portion and spline shaft of FIG. 48A.
Figure 48C:
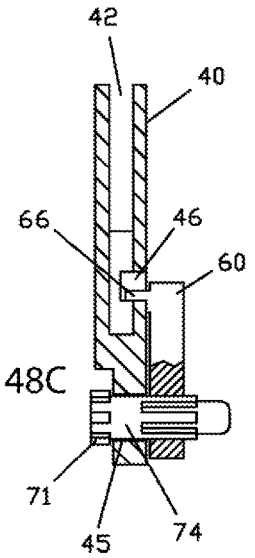
FIG. 48C is an end view of the assembled charging handle, load portion and spline shaft of FIG. 48A.
Figure 49A:
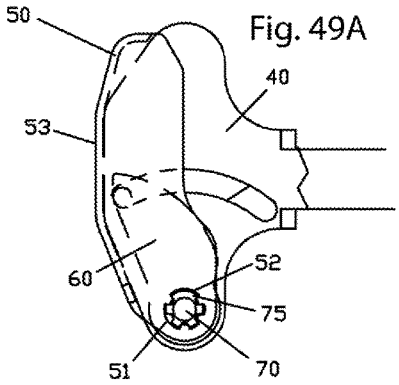
FIG. 49A is a top view of a charging handle, load portion, spline shaft and handle portion assembled together and shown in the stowed position.
Figure 49B:
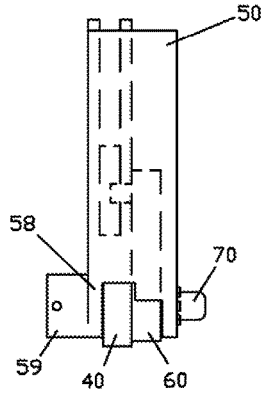
FIG. 49B is an end view of the assembled charging handle, load portion, spline shaft and handle portion of FIG. 49A.
Figure 49C:
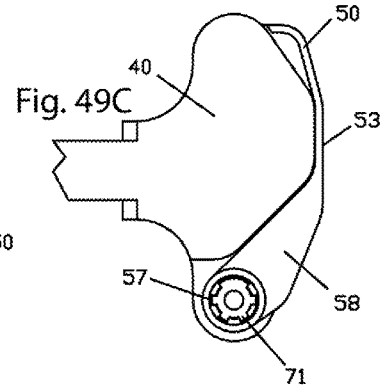
FIG. 49C is a bottom view of the assembled charging handle, load portion, spline shaft and handle portion of FIG. 49A.
Figure 50:
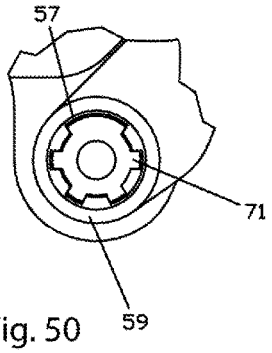
FIG. 50 is a close-up view of the spline shaft area of FIG. 49C.
Figure 51:
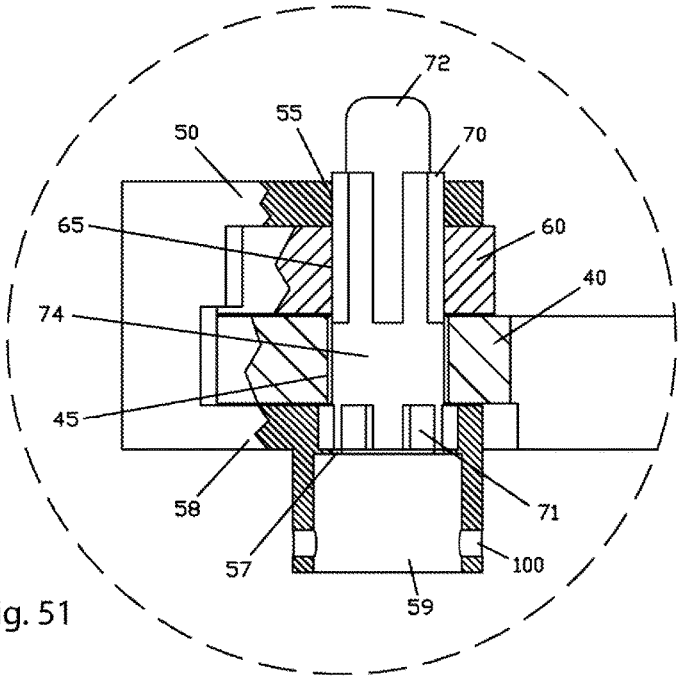
FIG. 51 is a partial cross-sectional side view of the assembly of FIG. 49A.

Referring now to FIGS. 46A-46B, a spline-spring guide 79 may be included to maintain proper control of spline-spring 78 (not shown), and/or to prevent unwanted dirt/debris from entering lower-arm well 59 of handle portion 50.

FIGS. 47A-48C illustrate load portion 60 and spline shaft 70 assembled together, with spline shaft 70 assembled into spline pivot hole 45 of charging handle base 40. As can be seen, cam lug 66 is in contact with the rearward end/surface of cam-lug passage 46 when load portion 60 is rotated counterclockwise as far as possible. Contact of cam lug 66 with the rearward end of cam-lug passage 46 of charging handle base 40 can limit the counterclockwise rotation of load portion 60.

Referring now FIGS. 48A-48C, which again illustrates load portion 60 and spline shaft 70 assembled together with spline shaft 70 assembled into spline pivot hole 45 of charging handle base 40, cam lug 66 is in contact with the forward end/surface of cam-lug passage 46. That is, load portion 60 is rotated clockwise as far as possible.

While cam lug 66 contacting the ends of cam-lug passage 46 has been described here as limiting the rotational extent of load portion 60, other means are envisioned. For example, other materials and/or surfaces could be added to charging handle base 40 to contact load portion 60 and limit the extent of rotation thereof in at least one direction.

In FIGS. 49A-51, load portion 60 and spline shaft 70 are assembled together with spline shaft 70 assembled into spline pivot hole 45 of charging handle base 40 and load portion 60 rotated counterclockwise until cam lug 66 contacts the rearward end of cam-lug passage 46. As can be seen in these figures, handle portion 50 with lower lever-arm 58 acting in conjunction with spline shaft 70 can hold the charging handle in assembly. For example, handle portion 50 with lower lever-arm 58 can encircle charging handle base 40 and load portion 60 to resist them from separating vertically. Spline shaft 70 can pin charging handle base 40, load portion 60, and handle portion 50 together, resisting them from separating laterally.

The charging handle can be assembled in the following order, starting with charging handle base 40: Load portion 60 positioned on handle base 40 with cam lug 66 positioned in cam-lug passage 46. Handle portion 50 is position on load portion 60 and handle base 40 with handle spline hole 55 aligned above cam spline hole 65 of load portion 60 and large diameter spline hole 57 of lower lever-arm 58 positioned below spline pivot hole 45 of handle base 40. Spline shaft 70 is inserted up through large diameter spline hole 57, spline pivot hole 45, cam spline hole 65, and handle spline hole 55. Spline shaft 70 can have a large diameter spline 71 that is larger than spline pivot hole 45 so as to prohibit the large diameter spline 71 from passing through the spline pivot hole 45. Advantageously, spline shaft 70 can maintain the assembly in the assembled configuration as long as spline shaft 70 is maintained in the spline pivot hole, cam spline hole, and handle spline hole.

Still referring to FIGS. 49A-51, where it can be seen that the spline lands of spline shaft 70 are engaged with the spline teeth of handle spline hole 55, the spline lands of large diameter spline 71 of spline shaft 70 can be engaged with the spline teeth of large diameter spline hole 57 of handle portion 50 and/or the spline lands of spline shaft 70 can be engaged to the spline teeth of load portion 60. When engaged to handle portion 50 and load portion 60, spline shaft 70 can prevent the parts from rotating. That is, load portion 60 cannot rotate counterclockwise because of the engagement of cam lug 66 with cam-lug passage 46, and handle portion 50 cannot rotate in a clockwise direction because lever back-strap 53 of handle portion 50 is in contact with charging handle base 40. Because spline shaft 70 ties all three parts together, via the spline engagements, the three parts are held in fixed position.

It is envisioned that the interior of lower-arm well 59 may not contain spline teeth below large diameter spline hole 57. Additionally or alternatively, the spline lands of spline shaft 70 may not extend down the full length of spline shaft 70. For example, the spline lands may terminate just below load portion 60 leaving solid/cylindrical portion 74, of spline shaft 70, to contact charging handle base 40, in spline pivot hole 45. Spline-button 72 can be cylindrical and can extend well above handle portion 50.

Figure 52:
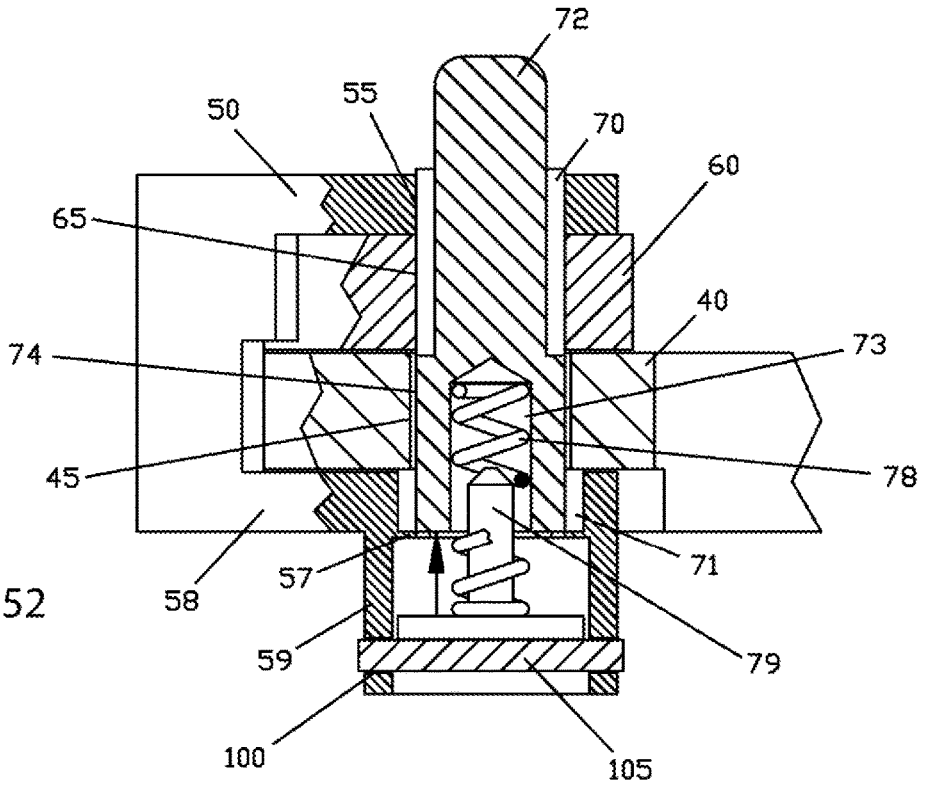
FIG. 52 is a partial cross-sectional view of the assembly of FIG. 49A with the spline shaft in an upper position and spline lands of the spline shaft engaged with the spline teeth of the handle portion.

Turning now to FIG. 52, which illustrates spline shaft 70 in an engaged position, a spline-spring 78 can fit within spline-spring pocket 73 of spline shaft 70 and a spline-spring guide 79 can fit within spline-spring 78 and lower-arm well 59 of handle portion 50. Spline-spring guide 79 can be configured to fit within, and support, spline-spring 78 within spline-spring pocket 73. Additionally, spline-spring guide 79 can closely fit (radially) within lower-arm well 59 of handle portion 50. Configured in this way, spline-spring guide 79 can support spline-spring 78 and resist dirt from entering lower-arm well 59. The spline-spring guide 79 can be retained by spline retainer pin 105. The spline-spring 78 urges spline shaft 70 upward.

Figure 53:
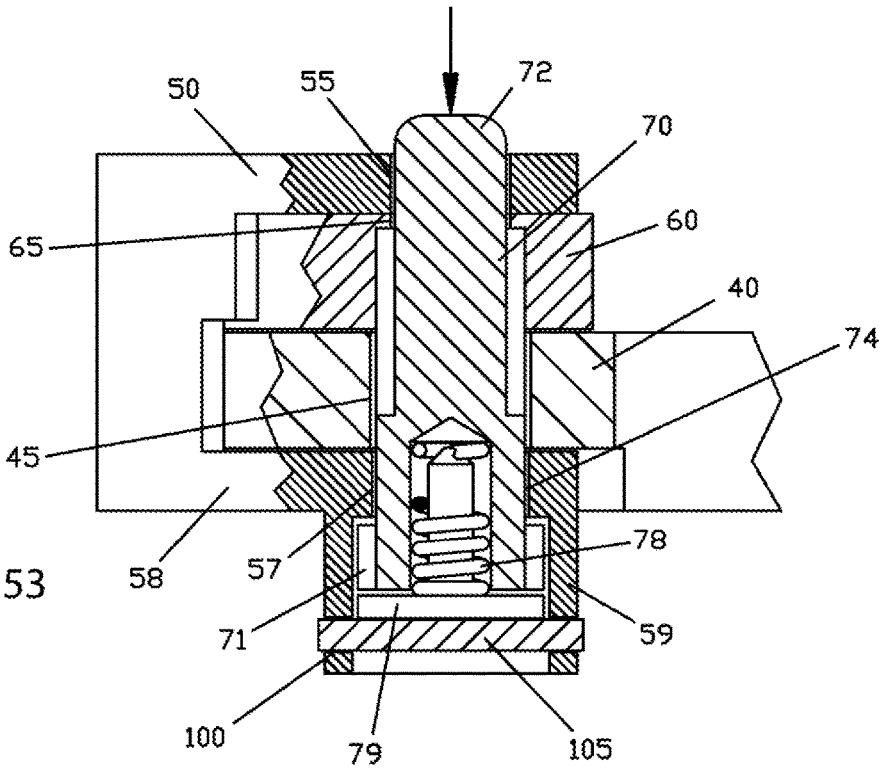
FIG. 53 is a partial cross-sectional view of the assembly of FIG. 49A with the spline shaft in a lower position and spline lands of the spline shaft not engaged with the spline teeth of the handle portion.

FIG. 53 illustrates spline shaft 70 in a disengaged position. In the disengaged position, spline shaft 70 is lowered/ depressed so that the spline lands, of spline shaft 70, have disengaged from the spline teeth of handle portion 50. Specifically, the spline lands of spline shaft 70 have disengaged from (e.g., dropped below) the spline teeth of handle spline hole 55, and the spline lands of large diameter spline 71 have disengaged from (e.g., dropped below) the spline teeth of large diameter spline hole 57.

Although the spline lands/teeth themselves have disengaged, the cylindrical portions of spline shaft 70 are still contacting/guiding handle portion 50. That is, the cylindrical sides of spline-button 72 are configured to fit within, and guide upon, the internal diameter of the spline teeth of handle spline hole 55. Also, cylindrical portion 74, of spline shaft 70, is configured to fit within, and guide upon, the internal diameter of the spline teeth of large diameter spline hole 57. Guided in this way, handle portion 50 is still constrained concentrically by/with spline shaft 70, which is itself held in spline pivot hole 45, despite the spline lands/teeth themselves being disengaged. In other words, handle portion 50 is now free to rotate around the cylindrical portions of spline shaft 70, into the deployed position or vice-versa.

As illustrated in FIG. 53, the spline lands of spline shaft 70 are engaged to the spline teeth of load portion 60. Also, the downward travel of spline shaft 70 is limited by a spline retainer pin 105. The spline retainer pin 105 is depicted here as a pin (e.g., dowel), however a large variety of other retainer options are contemplated, including but not limited to: roll/spring/taper/cotter/etc.-pins, retaining rings, spring-clips, safety-wires, etc. Also, retention options that do not require additional components could also be employed, such as: press-fitting spline-spring guide 79 into lower-arm well 59, or swedging/forming/bending lower-arm well 59 over/shut after assembly, or gluing/welding/etc. spline-spring guide 79 into lower-arm well 59, etc.

Figure 54:
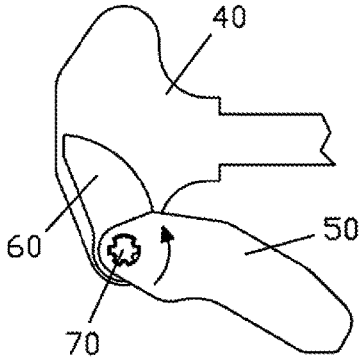
FIG. 54 is a top view of a charging handle with spline lands of a spline shaft in engagement with the spline teeth of the handle portion and the handle portion in the deployed position.
Figure 55:
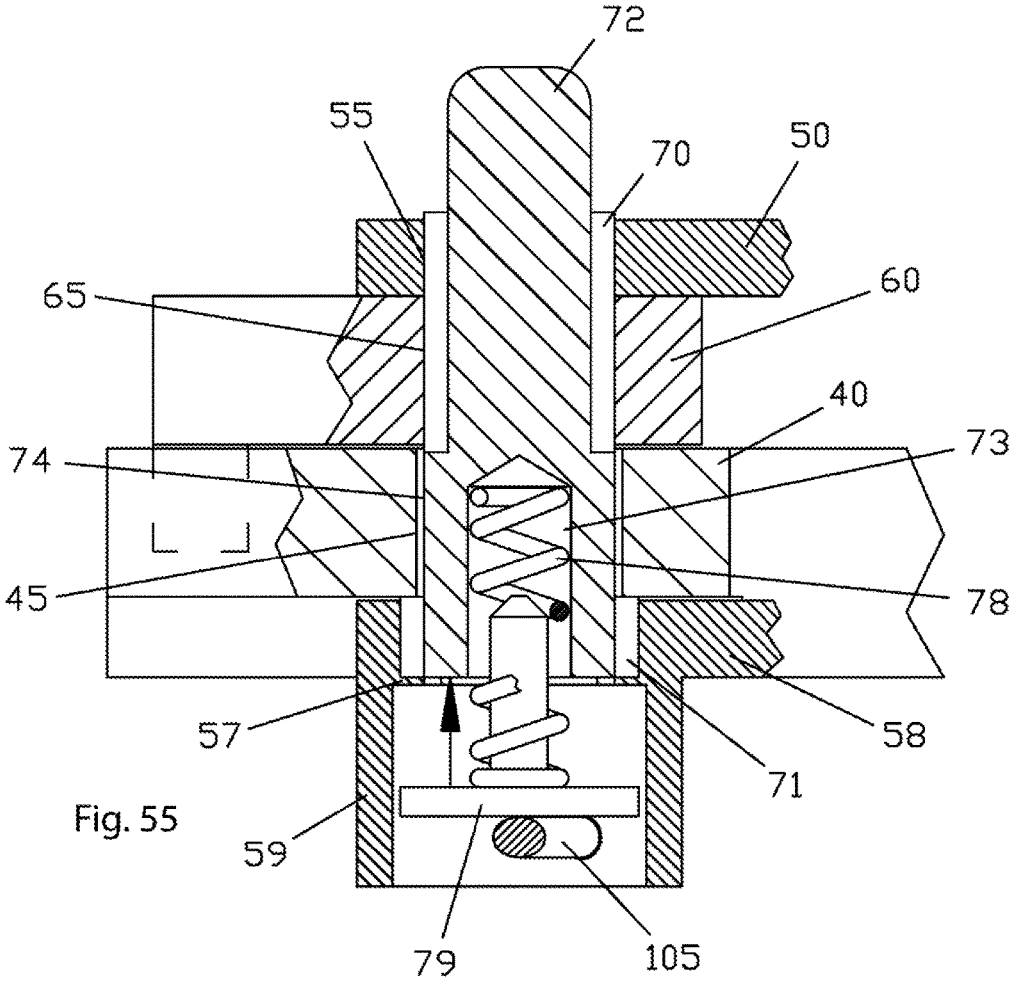
FIG. 55 is a partial cross-sectional side view of the spline shaft of FIG. 54.

In FIG. 54, handle portion 50 has been rotated back into the deployed position. When handle portion 50 is rotated into the deployed position, spline shaft 70 is able to, under the influence of spline-spring 78, reciprocate upwards so that the spline lands of spline shaft 70 engage with the spline teeth of handle portion 50, as shown in FIG. 55, with land 75 of spline shaft 70 engaged with first lever spline gap 51. In comparison, when handle portion 50 is in the retracted position, land 75 is aligned with, and can engage, second lever spline gap 52.

In the deployed configuration with spline shaft 70 engaged with handle portion 50 and load portion 60, the charging handle is ready to perform the rearward-assist caroming functions described above. Notably, spline shaft 70 and load portion 60 may not rotate relative to each other when handle portion 50 is configured into the deployed configuration and/or the stowed configuration.

Figure 56:
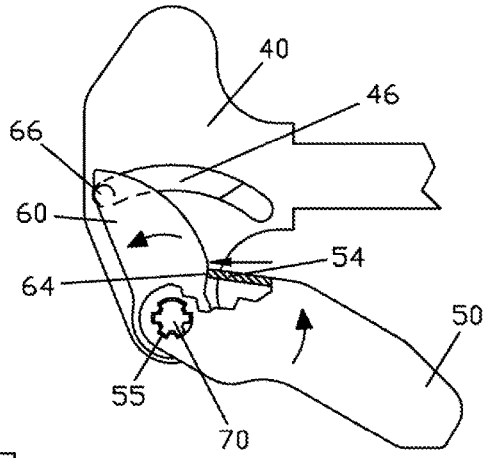
FIG. 56 is a top view illustrating a cam-lug passage of a charging handle base, a cam-lug, and an interface prong limiting counterclockwise rotation of the lever portions.

FIG. 56, is a partial sectional plan view illustrating the interaction of interface prong 54 with interface notch 64. Interface prong 54 limits the rotation of handle portion 50 and load portion 60 relative to one another. For example, the interface prong can limit the distance, in at least one direction, that handle portion 50 can rotate relative to load portion 60.

As can be seen, while handle portion 50 is being rotated (e.g., counterclockwise) into the deployed position, interface prong 54, of handle portion 50, will contact interface notch 64, of load portion 60. In so doing, interface prong 54 may rotate load portion 60 rearward so as to align the spline lands of spline shaft 70 with the spline teeth and spline gaps of handle portion 50. In such an arrangement, interface prong 54 may also restrict handle portion 50 from rotating beyond alignment with load portion 60 and/or spline shaft 70. In embodiments including a cam-lug and a cam-lug passage (e.g., cam lug 66 and cam-lug passage 46), rotation of the load portion 60 may be limited by contact of the cam-lug with a rear surface of the cam-lug passage. Accordingly, structure for limiting rotation of both load portion 60 and handle portion 50 relative to charging handle base 40 has been disclosed.

Figure 57A:
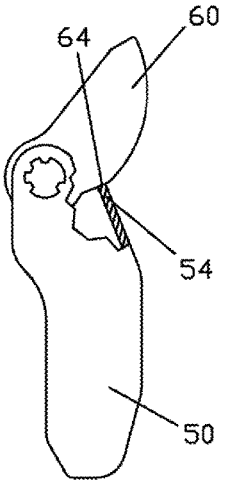
FIG. 57A is a top view of the load portion, handle portion, and interface prong of FIG. 56.
Figure 57B:
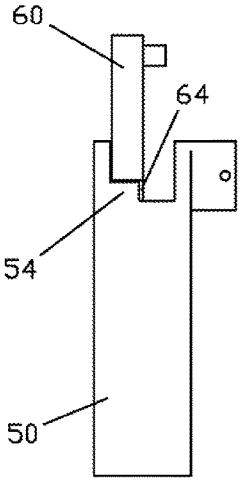
FIG. 57B is a side view of the load portion, handle portion, and interface prong of FIG. 56.

FIGS. 57A and 57B illustrate the interaction between interface prong 54 and interface notch 64. Again, interface prong 54 is arranged to limit the distance handle portion 50 may rotate in at least one direction (e.g., counterclockwise) relative to load portion 60.

Figure 58:
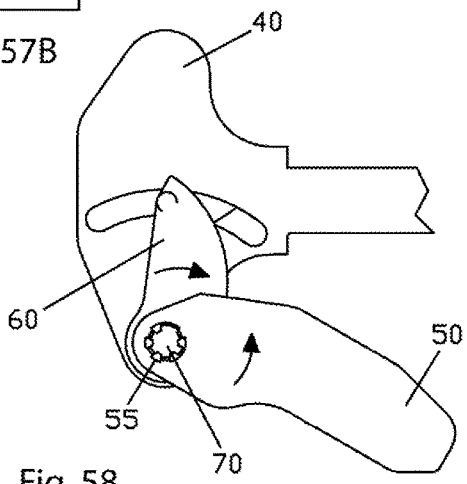
FIG. 58 illustrates a configuration resisted by the structure of FIGS. 56, 57A, and 57B.

FIG. 58 depicts an orientation which may occur if the charging handle does not include an interface prong. In this illustration, handle portion 50 has rotated (counterclockwise) into the fully deployed position, but load portion 60 remains in a forward (clockwise) rotational position. As can be seen, spline shaft 70, which is engaged with load portion 60, is misaligned with handle spline hole 55, and therefore the spline lands of spline shaft 70 cannot engage with the spline teeth of handle portion 50.

Figure 59:
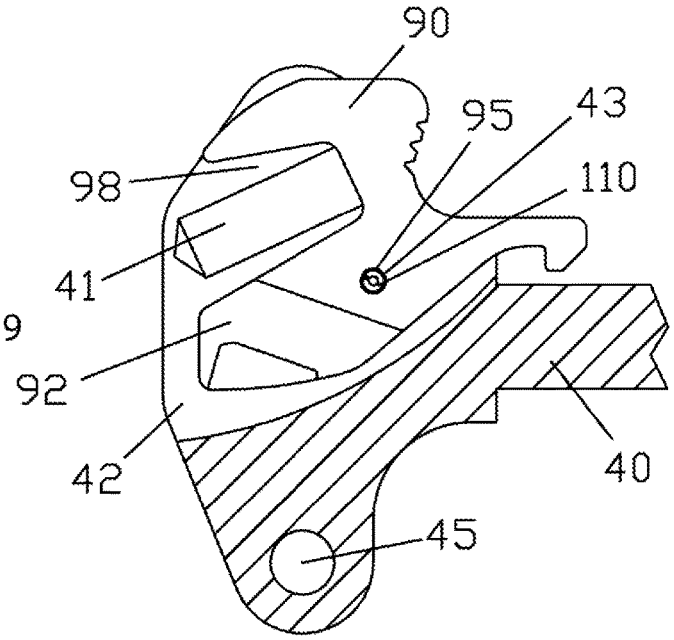
FIG. 59 is a top, partial sectional view of a charging handle-latch assembled into the charging handle.

FIG. 59 depicts a partial sectional plan view of charging handle base 40 with latch 90 assembled into latch-slot 42. A latch pivot pin 110 is assembled into latch pivot hole 95, of latch 90 and latch-retainer hole 43, of charging handle base 40. Latch 90 is pivotable around latch pivot pin 110. Latch pivot pin 110 is depicted as a roll-pin; however, other retention devices may be used.

Figure 60A:
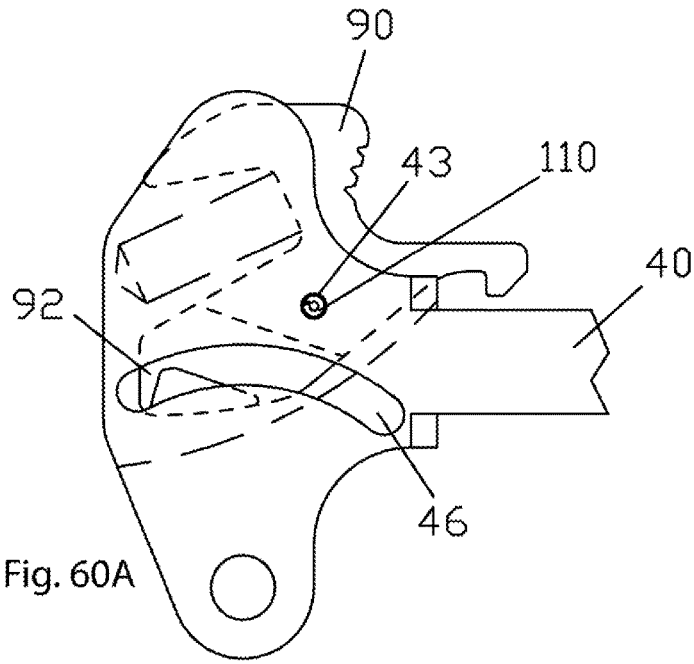
FIG. 60A is a top view of the assembly of FIG. 59.
Figure 60B:
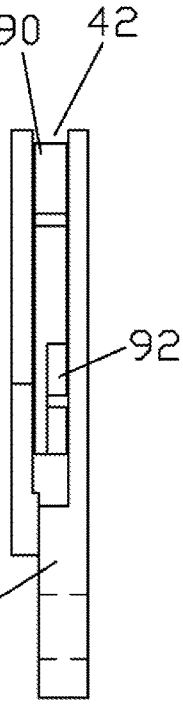
FIG. 60B is an end view of the assembly of FIG. 60A.

In this view the orientation of latch-spring pocket 41 and latch-spring notch 98 can be clearly seen. Latch-spring pocket 41, of charging handle base 40, opens towards latch-spring notch 98. Referring now to FIGS. 60A and 60B, the relative orientation of cam-lug passage 46 to cam-lug track 92 can be seen. When latch 90 is assembled into latch-slot 42, cam-lug track 92 is positioned beneath, and can be accessible through, cam-lug passage 46.

Figure 61:
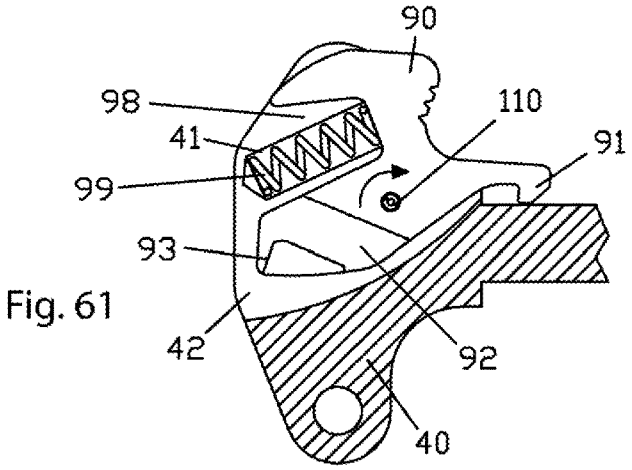
FIG. 61 is a partial sectional plan view of the charging handle-latch and spring assembled into the charging handle.

Referring now to FIG. 61, a latch-spring 99 fits within latch-spring pocket 41 of charging handle base 40 and latch-spring notch 98 of latch 90. As can be seen in this figure, latch-spring 99 urges latch 90 to rotated around latch pivot pin 110, in a clockwise direction. In some instances, latch-spring 99 may bias latch 90 around latch pivot pin 110 until hook 91, of latch 90, contacts charging handle base 40.

Figure 62A:
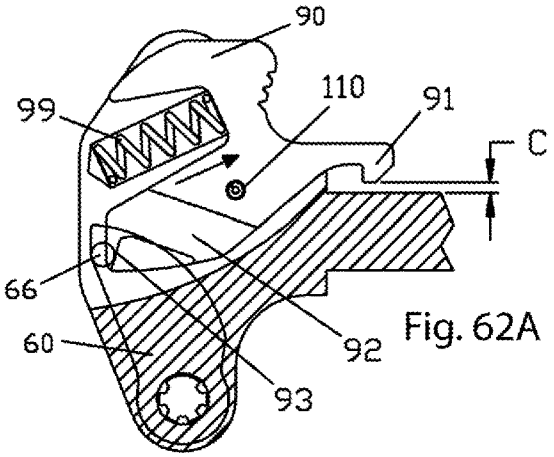
FIG. 62A is a partial sectional plan view of the charging handle-latch and spring assembled into the charging handle, with an outline of the load portion (e.g., cam) for reference.
Figure 62B:
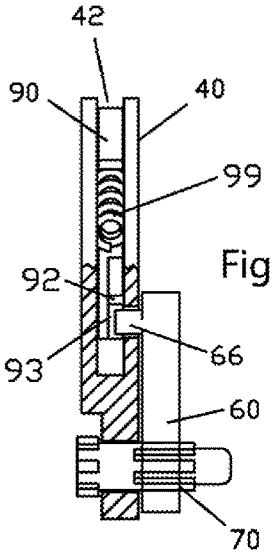
FIG. 62B is an end view of the assembly of FIG. 62A.

FIGS. 62A and 62B include load portion 60 in transparent form. That is, the edges of load portion 60 are shown, but none of the other components below load portion 60 have been obscured. This has been done so that the relative location of cam lug 66 and cam-lug track 92 can be seen. Cam lug 66 extends down through cam-lug passage 46 (not shown for clarity), of charging handle base 40, into cam-lug track 92, of latch 90.

Figure 63:
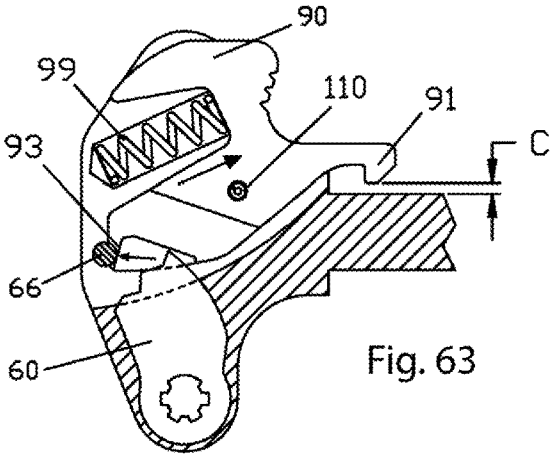
FIG. 63 is a partial sectional plan view of the charging handle-latch and spring assembled into the charging handle, with the load portion partially cut-away for a clearer view of the cam-lug and latch.

In FIG. 63, first latch cam 93 of latch 90 is in contact with cam lug 66 of load portion 60. In the illustrated embodiment, hook 91 is spaced from charging handle base 40, creating gap C, in this configuration. Latch-spring 99, which is compressed slightly as compared to FIG. 61, is still urging latch 90 to rotate in a clockwise direction but clockwise rotation of latch 90 is limited by contact with cam lug 66 of load portion 60 rather than contact of hook 91 of latch 90 with charging handle base 40 as shown in FIG. 61. Advantageously, such an arrangement maintains cam lug 66 and first latch cam 93 in close proximity so that clockwise rotation of load portion 60 during operation of the charging handle immediately begins moving the latch to an unlatched configuration.

Referring now to FIG. 63, which is identical to FIGS. 62A and 62B, except with load portion 60 being sectioned rather than being transparent, the interaction between cam lug 66 and latch 90 can be clearly seen. Under pressure from latch-spring 99, first latch cam 93 of latch 90 puts rearward pressure on cam lug 66. Again, in some instances, load portion 60 may be limited from rotating farther in the counterclockwise direction because cam lug 66 is in contact with the rear of cam-lug passage 46 (not shown).

Figure 64:
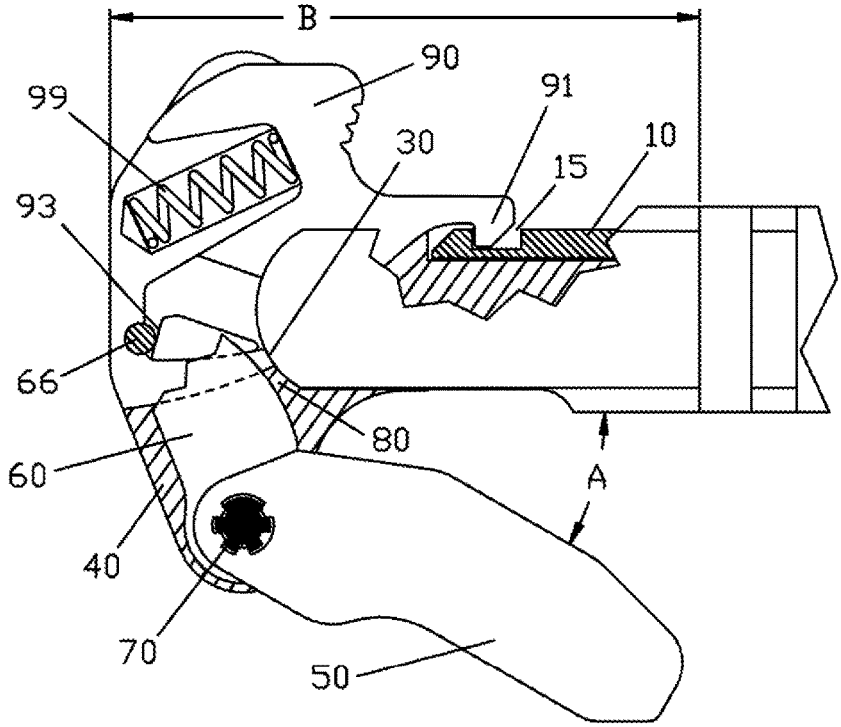
FIG. 64 is a partial sectional plan view of the charging handle assembled into a receiver, with the latch hook engaged with the receiver notch.

In FIG. 64, the charging handle has been assembled into a receiver 10 with hook 91 of latch 90 engaged into receiver notch 15. Handle portion 50 is illustrated in the deployed (most acute angle "A") position, and charging handle base 40 is illustrated in its forward position (i.e., minimum distance B). Cam-gap 80 exists between load portion 60 and rearward-facing surface 30 of receiver 10.

Figure 65:
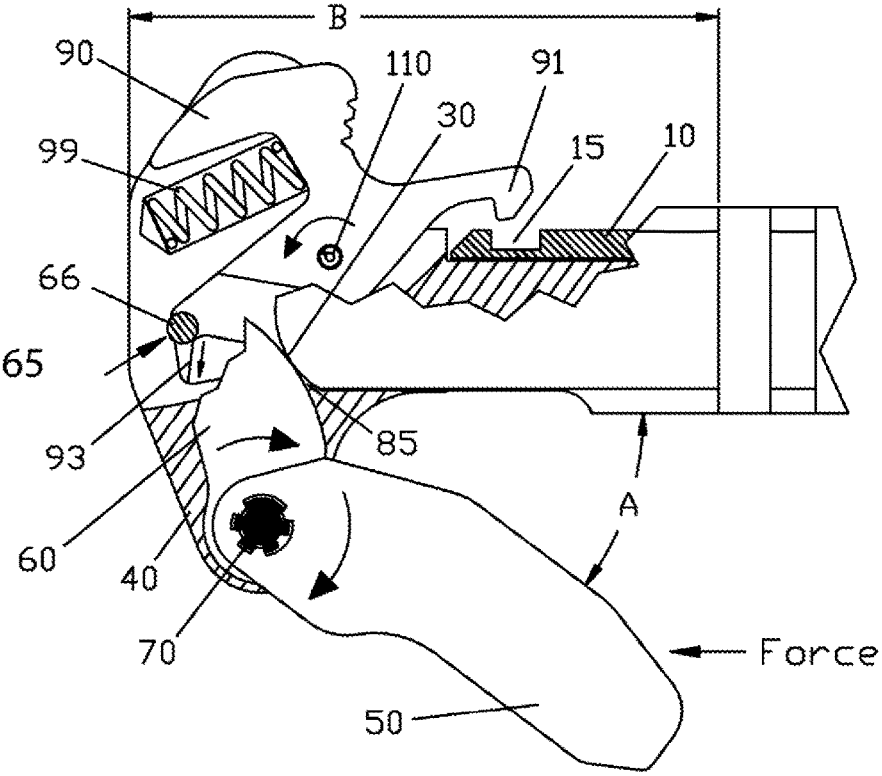
FIG. 65 is a partial sectional plan view of the charging handle assembled into a receiver, with the latch hook actuated out of engagement from the receiver notch and with the charging handle before rearward movement of the charging handle base.

FIG. 65 illustrates charging handle base 40, handle portion 50, and load portion 60 in the same position as shown in FIGS. 12 and 13. In FIG. 65, a rearward force has been applied to handle portion 50. The rearward force has caused handle portion 50 and load portion 60 to rotate slightly (as compared to FIG. 64), causing angle "A" to increase slightly. Cam-gap 80 has closed and load portion 60 is now in contact with rearward-facing surface 30 at fulcrum contact point 85, but charging handle base 40 has not yet moved rearward (i.e. distance B has not yet increased).

Still referring to FIG. 65, the forward pressure of cam lug 66 has caused latch 90 to rotate in a counterclockwise direction. That is, cam lug 66 has pressed forward against, and slid along, first latch cam 93 causing latch 90 to pivot around latch pivot pin 110. Accordingly, cam lug 66 has cammed first latch cam 93 downward (in the orientation shown in the figure). As can be seen latch-spring 99 has compressed slightly, and latch hook 91, of latch 90, has been rotated out of engagement with receiver notch 15.

Latch hook 91 may be completely disengaged from receiver notch 15 before load portion 60 begins to force the charging handle rearward. For example, the space provided by cam-gap 80 may allow the camming action of cam lug 66 (acting against first latch cam 93) to open charging handle latch 90 before the charging handle is forced rearward. Advantageously, such an arrangement can reduce the possibility of hook 91 resisting withdrawal of the charging handle from the firearm upon actuation of the handle portion 50 and load portion 60 to extract the charging handle.

Figure 66:
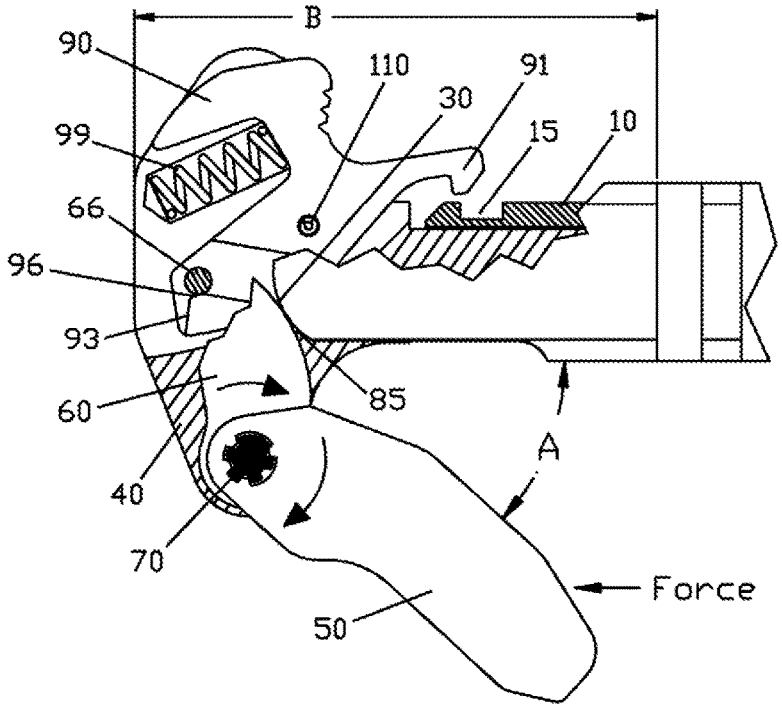
FIG. 66 is a partial sectional plan view of the charging handle assembled into a receiver, with the latch hook actuated out of engagement from the receiver notch and with the charging handle.

In FIG. 66, the charging handle has moved slightly rearward (i.e. distance-B has slightly increased) due at least in part to the force of load portion 60 against rearward-facing surface 30 at contact point 85. As can be seen, cam lug 66 has rotated out of contact with first latch cam 93 and is now sliding over cam dwell 96. Cam dwell 96 is configured to allow cam lug 66 to continue to move forward while latch 90 is held out of receiver notch 15. Advantageously, the cam dwell 96 can allow load portion 60 to push the charging handle rearward a significant distance without significant further rotation of latch 90 and compression of latch-spring 99.

Cam dwell 96 can allow the camming action of load portion 60 to accommodate manufacturing tolerances of the parts. For example, cam dwell 96 can allow load portion 60 to push the charging handle back sufficiently to ensure that when cam lug 66 begins to disengage from latch 90 that latch hook 91 is rearward of receiver notch 15.

Figure 67:
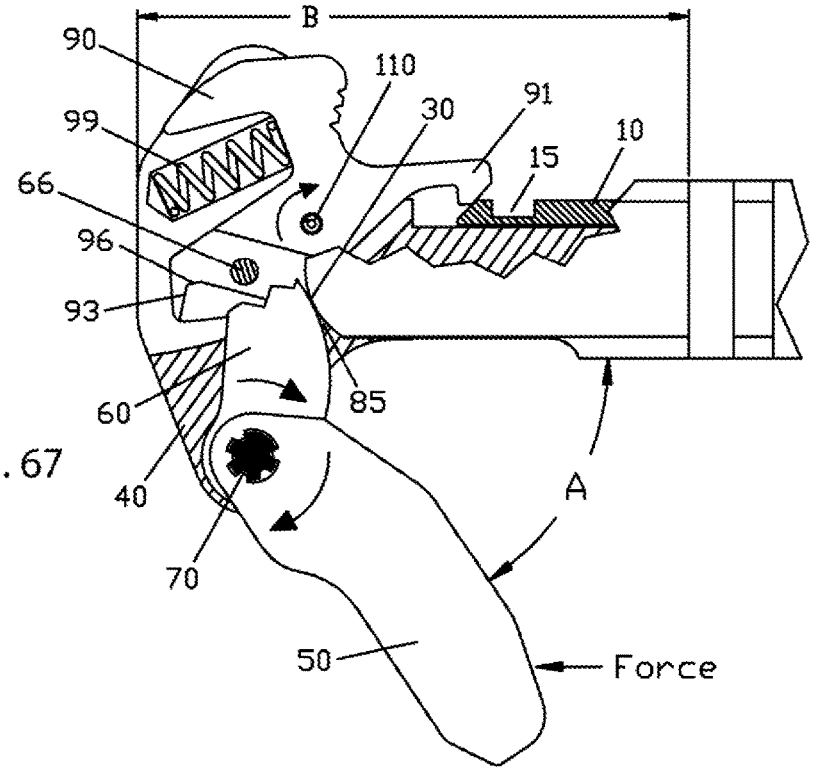
FIG. 67 is a partial sectional plan view of the charging handle assembled into a receiver, with the charging handle and latch hook moved rearward away from the receiver notch.

FIG. 67 illustrates the assembly after further rotation of handle portion 50 and load portion 60 and rearward movement of the charging handle. As can be seen, cam lug 66 has moved sufficiently forward as to disengage from cam dwell 96. In fact, cam lug 66 has rotated out of engagement from latch 90. In some instances, cam lug 66 may no longer be in contact with latch 90 due to latch hook 91 contacting a portion of the receiver rearward of the receiver notch 15 and, therefore, applying counterclockwise force to latch 90. Preferably, load portion 60, pressing on contact point 85, is arranged to separate the charging handle from the receiver sufficiently that latch hook 91 cannot reengage with receiver notch 15 when cam lug 66 disengages from latch 90. In other words, load portion 60 can be arranged such that cam lug 66 releases from latch 90 at a point in the charging handle's rearward movement where latch 90 cannot hook back into notch 15.

Turning now to FIG. 68, handle portion 50 and load portion 60 have rotated in a clockwise direction to a position wherein cam lug 66 is in contact with the forward end of cam lug passage 46 of charging handle base 40. The rearward force applied to handle portion 50 continues to move the charging handle rearward (increasing distance-B), separating load portion 60 from receiver 10. As can be seen, cam lug 66 has completely disengaged from latch 90, and latch 90, being urged by latch-spring 99, has rotated in a clockwise direction until hook 91 has stopped on the side of charging handle base 40.

Resetting the charging handle is illustrated in FIG. 69. During a reset, cam lug 66 passes back through cam-lug track 92 as handle portion 50 and load portion 60 are rotated in a counterclockwise direction. During such rotation, cam lug 66 comes into contact with second latch-cam 94 of latch 90. As cam lug 66 slides over second latch-cam 94, latch 90 rotates in a counterclockwise direction. That is, cam lug 66 cams second latch-cam 94 down, allowing latch 90 to rotate out of the way of cam lug 66. Continuing to rotate handle portion 50 and load portion 60 in this direction will eventually return handle portion 50 and load portion 60 to the position shown in FIGS. 10 and 11.

FIG. 70 illustrates that latch 90 can be actuated manually by depressing latch-button 97. That is, latch 90 can be actuated in the same manner as a latch. In other words, latch 90 can be actuated separately from handle portion 50 and load portion 60.

Figure 71A:
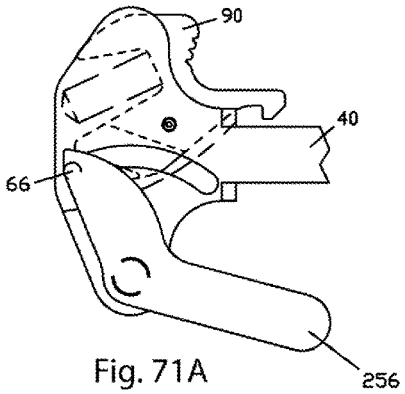
FIG. 71A is a top view of another embodiment of a charging handle.
Figure 71B:
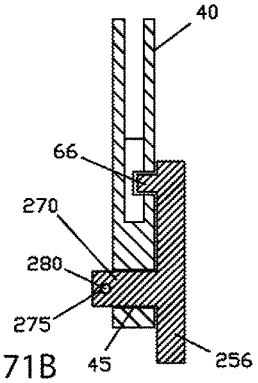
FIG. 71B is an end view of the embodiment of FIG. 71A.
Figure 71C:
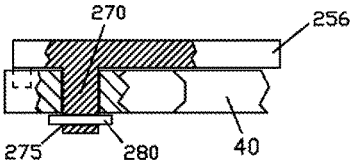
FIG. 71C is a side view of the embodiment of FIG. 71A.

FIGS. 71A-71C illustrate an embodiment in which handle portion 50, load portion 60 and spline shaft 70 (of previous Figures) have been combined into lever 256. Lever 256 operates in the same way as the handle portion 50, load portion 60 and spline shaft 70 of the preferred embodiment.

Lever 256 includes a pivot shaft 270 that extends through and pivots within spline pivot hole 45 of charging handle base 40. Lever 256 can be held assembled to charging handle base 40 by a pivot shaft retainer pin 280, assembled into pivot shaft retainer hole 275. Additionally or alternatively, another retention device (roll/taper/spring/etc. pins, retaining rings/clips/etc.) may be used and/or the bottom end of the pivot shaft 270 may be expanded (e.g., mushroomed) after assembly to retain lever 256 in association with charging handle base 40.

Figure 72A:
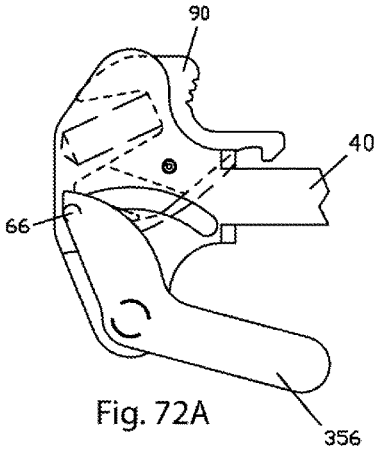
FIG. 72A is a top view of another embodiment of a charging handle.
Figure 72B:
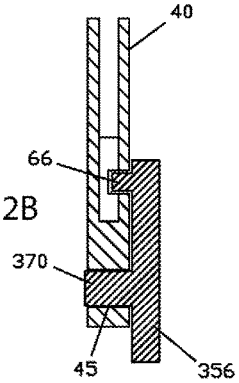
FIG. 72B is an end view of the embodiment of FIG. 72A.
Figure 72C:
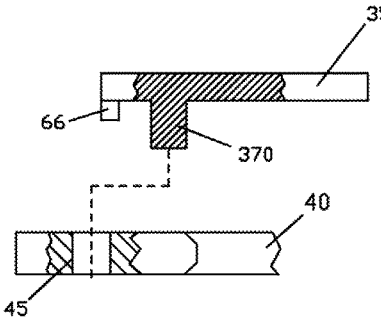
FIG. 72C is an exploded side view of the embodiment of FIG. 72A.

FIGS. 72A-72C illustrate an embodiment wherein the lever is removable from charging handle base 40. In this embodiment, removable lever 356 includes handle portion 50, load portion 60 and spline shaft 70; however, lever 356 can be disassembled from charging handle base 40 without requiring a tool and/or removal of a retainer pin.

FIGS. 73A-75 illustrate an embodiment of a lever that is backwards compatible with charging handle 20. FIGS. 73A-73C show the profile of backwards compatible lever 456 is similar to that of the previous figures of handle portion 50 and load portion 60, lever 256, and removable lever 356. It can also be seen that a lip 470 protrudes from the bottom of backwards compatible lever 456 in similar manner as did pivot shaft of removable lever 356 (of FIG. 21B). However, in this illustration, lip 470 is configured to interface with the forward surface of a charging handle.

FIGS. 74A-74C illustrate the backwards compatible lever 456 interfacing with charging handle 20, wherein lip 470 is engaged with a front face of charging handle 20.

As shown in FIG. 75, lip 470 of backwards compatible lever 456 can automatically actuate latch 25.

While the levers illustrated and described above have been first class levers, it is envisioned that a second class lever could be employed to multiply the removal force applied to the charging handle by a user. For example, the contact point 85 between the lever and the firearm could be positioned in an area between the spline shaft and the portion of lever that extends laterally away from the firearm (e.g., the handle). In such an arrangement a user would force the lever forward to try and separate the charging handle end from the firearm.

Additionally, while the above embodiments have illustrated and described a lever as the simple machine for multiplying force to remove the charging handle, other simple machines are envisioned as well. For example, the charging handle may include a screw that, when rotated, forces the charging handle away from the receiver of the firearm. Similarly, the charging handle may include one or more pulleys and cords that extend rearward from the charging handle to, for example, the buttstock. Accordingly, upon actuation of the cord, the charging handle may be forced rearward.

While the fulcrum (e.g., spline shaft) for illustrated embodiments is shown as being on the same side of the longitudinal axis of the charging handle as the handle portion 50, the fulcrum can be positioned on the opposing side of the longitudinal axis. Alternatively, rather than being offset from the longitudinal axis of the charging handle, the fulcrum may be aligned vertically with the longitudinal axis, the contact point, and/or both. Advantageously, such an arrangement can reduce the torsional force between the charging handle base and the receiver when force is applied to the lever.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The following numbered clauses set out specific embodiments that may be useful in understanding the present invention:

1. A charging handle for a firearm comprising:

a charging handle base having a first end and a second end;

the first end arranged for positioning within the firearm;

the second end having a charging handle latch pivotably attached thereto, the charging handle latch arranged to engage another part of the firearm to retain the second end in position; and a pivoting charging handle removal lever coupled to the charging handle base, the pivoting charging handle removal lever having three separate locations to achieve a mechanical advantage:

(a) a first location which engages the charging handle base or the charging handle latch, (b) a second location which engages a different part of the firearm than the charging handle base or the charging handle latch, and (c) a third location exposed for application of manual force and positioned to achieve a mechanical advantage for releasing the charging handle when stuck in the firearm.

2. The charging handle of clause 1, wherein the first location is positioned in an area between the second location and the third location.

3. The charging handle of any preceding clause, wherein the pivoting charging handle removal lever disengages the charging handle latch from the firearm when actuated.

4. The charging handle of any preceding clause, wherein the pivoting charging handle includes a cam-lug that rotates the charging handle latch away from the charging handle base during rotation of the pivoting charging handle removal lever.

5. The charging handle of any preceding clause, wherein the pivoting charging handle removal lever includes a handle portion extending from the first location to the third location and a load portion extending from the first location to the second location; and wherein the handle portion is selectively pivotable relative to the load portion so as to configure the pivoting charging handle removal lever from stored configuration to a deployed configuration.

6. The charging handle of any preceding clause, wherein the handle portion is coupled to the load portion by a spline shaft having splines; and wherein the handle portion and load portion each have spline openings having one or more teeth and gaps sized to engage the spline shaft.

7. The charging handle of clause 6, wherein the spline shaft, the handle portion, and the load portion are arranged such that the spline shaft rotationally couples the handle portion and the load portion in one or two configurations.

8. The charging handle of clause 6 or 7, wherein the spline shaft has a first circumferential portion that, when positioned within the spline opening of the load portion, rotationally locks the spline shaft relative to the load portion; and wherein the spline shaft has a second circumferential portion that, when positioned within the spline opening of the load portion, allows at least 50 degrees of rotation of the load portion relative to the spline shaft.

9. The charging handle of any preceding clause, wherein the charging handle is for an AR style firearm.

10. The charging handle of any preceding clause, wherein:

the first end of the charging handle base defines an opening arranged to receive a portion of a bolt carrier group of the firearm.

11. A charging handle for a firearm comprising:

a charging handle base having a first end and a second end;

the first end arranged for positioning within a housing of the firearm;

the second end having a charging handle latch pivotably attached thereto, the charging handle latch arranged to engage the firearm to retain the second end in fixed position relative to the housing; and a rearward-assist member arranged to provide a mechanical advantage upon application of a force to move the second end of the charging handle base away from the housing when the charging handle latch is disengaged from the firearm.

12. The charging handle of clause 11, wherein:

when the rearward-assist member disengages the charging handle latch from the housing when actuated.

13. The charging handle of clause 11 or 12, wherein:

the rearward-assist member is a simple machine.

14. The charging handle of any one of clauses 11-13, wherein:

the simple machine is a lever pivotably coupled to the charging handle base, the lever having three separate locations to achieve a mechanical advantage:

(a) a first location pivotably coupled to the charging handle base, (b) a second location which engages the firearm, and (c) a third location comprising a handle for contact with a user's hand.

15. The charging handle of clause 14, wherein the first location is positioned in an area between the second location and the third location.

16. The charging handle of any one of clauses 11-15, wherein the lever includes a cam-lug that rotates the charging handle latch away from the charging handle base during rotation of the lever.

17. The charging handle of any one of clauses 14-16, wherein the lever includes a handle portion extending from the first location to the third location and a load portion extending from the first location to the second location; and wherein the handle portion is selectively pivotable relative to the load portion so as to configure the lever from stored configuration to a deployed configuration.

18. The charging handle of clause 17, wherein the handle portion is coupled to the load portion by a spline shaft having splines; and wherein the handle portion and load portion each have spline openings having one or more teeth and gaps sized to engage the spline shaft 19. The charging handle of any one of clauses 11-18, wherein the charging handle is for an AR style firearm.

20. The charging handle of any one of clauses 11-19, wherein:

the first end of the charging handle base defines an opening arranged to receive a portion of a bolt carrier group of the firearm.

The invention claimed is:

1. A charging handle for a firearm comprising:

a charging handle base having a first end and a second end;

the first end arranged for positioning within a first part of the firearm;

the second end having a charging handle latch pivotably attached thereto, the charging handle latch arranged to engage a second part of the firearm to retain the second end in position; and a pivoting charging handle removal lever coupled to the charging handle base, the pivoting charging handle removal lever having three separate locations to achieve a mechanical advantage:

(a) a first location which engages the charging handle base or the charging handle latch, (b) a second location which engages a third part of the firearm different than the first part of the firearm and the second part of the firearm, and (c) a third location exposed for application of manual force and positioned to achieve a mechanical advantage for releasing the charging handle when stuck in the firearm.

2. The charging handle of claim 1, wherein the first location is positioned in an area between the second location and the third location.

3. The charging handle of claim 1, wherein the pivoting charging handle removal lever disengages the charging handle latch from the firearm when actuated.

4. The charging handle of claim 3, wherein the pivoting charging handle includes a cam-lug that rotates the charging handle latch away from the charging handle base during rotation of the pivoting charging handle removal lever.

5. The charging handle of claim 1, wherein the pivoting charging handle removal lever includes a handle portion extending from the first location to the third location and a load portion extending from the first location to the second location; and wherein the handle portion is selectively pivotable relative to the load portion so as to configure the pivoting charging handle removal lever from stored configuration to a deployed configuration.

6. The charging handle of claim 5, wherein the handle portion is coupled to the load portion by a spline shaft having splines; and wherein the handle portion and load portion each have spline openings having one or more teeth and gaps sized to engage the spline shaft.

7. The charging handle of claim 6, wherein the spline shaft, the handle portion, and the load portion are arranged such that the spline shaft rotationally couples the handle portion and the load portion in one or two configurations.

8. The charging handle of claim 7, wherein the spline shaft has a first circumferential portion that, when positioned within the spline opening of the load portion, rotationally locks the spline shaft relative to the load portion; and wherein the spline shaft has a second circumferential portion that, when positioned within the spline opening of the load portion, allows at least 50 degrees of rotation of the load portion relative to the spline shaft.

9. The charging handle of claim 1, wherein the charging handle is for an AR style firearm.

10. The charging handle of claim 9, wherein:

the first end of the charging handle base defines an opening arranged to receive a portion of a bolt carrier group of the firearm.

11. A charging handle for a firearm comprising:

a charging handle base having a first end and a second end;

the first end arranged for positioning within a housing of the firearm;

the second end having a charging handle latch pivotably attached thereto, the charging handle latch arranged to engage the firearm to retain the second end in fixed position relative to the housing; and a rearward-assist member arranged to provide a mechanical advantage upon application of a force to move the second end of the charging handle base away from the housing when the charging handle latch is disengaged from the firearm;

wherein the rearward-assist member is arranged to apply a force against the firearm over a range of movement of the second end away from the housing.

12. The charging handle of claim 11, wherein:

when the rearward-assist member disengages the charging handle latch from the housing when actuated.

13. The charging handle of claim 11, wherein:

the rearward-assist member is a simple machine.

14. The charging handle of claim 13, wherein:

the simple machine is a lever pivotably coupled to the charging handle base, the lever having three separate locations to achieve a mechanical advantage:

(a) a first location pivotably coupled to the charging handle base, (b) a second location which engages the firearm, and (c) a third location comprising a handle for contact with a user's hand.

15. The charging handle of claim 14, wherein the first location is positioned in an area between the second location and the third location.

16. The charging handle of claim 14, wherein the lever includes a cam-lug that rotates the charging handle latch away from the charging handle base during rotation of the lever.

17. The charging handle of claim 15, wherein the lever includes a handle portion extending from the first location to the third location and a load portion extending from the first location to the second location; and wherein the handle portion is selectively pivotable relative to the load portion so as to configure the lever from stored configuration to a deployed configuration.

18. The charging handle of claim 17, wherein the handle portion is coupled to the load portion by a spline shaft having splines; and wherein the handle portion and load portion each have spline openings having one or more teeth and gaps sized to engage the spline shaft.

19. The charging handle of claim 11, wherein the charging handle is for an AR style firearm.

20. The charging handle of claim 19, wherein:

the first end of the charging handle base defines an opening arranged to receive a portion of a bolt carrier group of the firearm.

* * * * *